US010524529B2

(12) United States Patent
Muskovitz

(10) Patent No.: US 10,524,529 B2
(45) Date of Patent: Jan. 7, 2020

(54) IN-MOLD PROTECTIVE HELMET HAVING INTEGRATED VENTILATION SYSTEM

(71) Applicant: David T. Muskovitz, Park City, UT (US)

(72) Inventor: David T. Muskovitz, Park City, UT (US)

(73) Assignee: RESOLUTION STRATEGIC DEVELOPMENT, INC., Park City, UT (US)

( * ) Notice: Subject to any disclaimer, the term of this patent is extended or adjusted under 35 U.S.C. 154(b) by 554 days.

(21) Appl. No.: 15/146,481

(22) Filed: May 4, 2016

(65) Prior Publication Data

US 2016/0242488 A1 Aug. 25, 2016

Related U.S. Application Data

(60) Continuation of application No. 13/603,123, filed on Sep. 4, 2012, now Pat. No. 9,332,801, which is a division of application No. 12/182,016, filed on Jul. 29, 2008, now Pat. No. 8,256,032, which is a continuation of application No. 10/447,686, filed on May 29, 2003, now abandoned.

(60) Provisional application No. 60/383,907, filed on May 29, 2002.

(51) Int. Cl.

| | |
|---|---|
| ***A42B 3/00*** | (2006.01) |
| ***A42B 3/28*** | (2006.01) |
| ***A42B 3/12*** | (2006.01) |

(52) U.S. Cl.

CPC ..... *A42B 3/283* (2013.01); *A42B 3/12* (2013.01)

(58) Field of Classification Search

CPC ..... A61F 9/045; G02C 7/16; G02C 9/02
USPC ..... 2/412, 171.3, 171.4, 6.6
See application file for complete search history.

(56) References Cited

U.S. PATENT DOCUMENTS

| | | | | |
|---|---|---|---|---|
| 3,860,966 A | | 1/1975 | Brown et al. | |
| 4,434,514 A | | 3/1984 | Sundahl et al. | |
| 4,964,178 A | | 10/1990 | Giancarlo et al. | |
| 4,995,117 A | * | 2/1991 | Mirage | A42B 3/0493 2/410 |
| 5,058,212 A | * | 10/1991 | Kamata | A42B 3/283 2/171.3 |
| 5,165,116 A | | 11/1992 | Simpson | |
| 5,170,511 A | * | 12/1992 | Kamata | A42B 3/283 2/424 |
| 6,009,562 A | | 1/2000 | Bullock et al. | |
| 6,058,515 A | * | 5/2000 | Kitahara | A42B 3/128 2/412 |
| 6,061,834 A | | 5/2000 | Liao | |

(Continued)

*Primary Examiner* — Timothy K Trieu
(74) *Attorney, Agent, or Firm* — Workman Nydegger

(57) ABSTRACT

The present invention provides a lightweight protective helmet having an improved ventilation system therein. The protective helmet comprises an outer shell and an inner liner that are joined together to form a shell/liner composite. The ventilation system interacts with one or more ventilation ports in the protective helmet to control the flow of ambient air in and out of the interior of the protective helmet. The ventilation system may be integrated or encased within the shell/liner composite, or it may be adapted to be used on the exterior of the helmet. In addition, the ventilation system may include one of several types of interchangeable insert members to allow active or passive control of ambient air into the interior of the helmet.

17 Claims, 19 Drawing Sheets

(56) References Cited

U.S. PATENT DOCUMENTS

| | | | | |
|---|---|---|---|---|
| 6,823,531 | B1 * | 11/2004 | Chen | A42B 3/283 2/171.3 |
| 6,904,618 | B2 | 6/2005 | Musal | |
| 9,332,801 | B2 | 5/2016 | Muskovitz | |
| 2004/0064873 | A1 * | 4/2004 | Muskovitz | A42B 3/283 2/410 |
| 2014/0123360 | A1 * | 5/2014 | Cohen | F41H 1/04 2/6.6 |

* cited by examiner

IN-MOLD PROTECTIVE HELMET HAVING INTEGRATED VENTILATION SYSTEM

CROSS REFERENCE TO RELATED APPLICATIONS

This application is a continuation of U.S. patent application Ser. No. 13/603,123, filed Sep. 4, 2012, which is a divisional of U.S. patent application Ser. No. 12/182,016, filed Jul. 29, 2008, now U.S. Pat. No. 8,256,032, which is a continuation of U.S. patent application Ser. No. 10/447,686, filed May 29, 2003, abandoned, which claims the benefit of U.S. Provisional Application No. 60/383,907, filed May 29, 2002, the disclosures of which are incorporated herein in their entirety.

BACKGROUND

1. Field of the Invention

The present invention relates to protective helmets designed to protect the user from potential impacts to the head during bicycling, skiing, snowboarding, and other sporting adventures. Specifically, the present invention relates to a protective helmet providing improved ambient airflow throughout the interior of the helmet using a unique ported and adjustable fluid airflow system.

2. Background of the Invention

Athletes and outdoor enthusiasts alike have long recognized the importance of wearing protective head gear or helmets when engaged in sporting events such as bicycling, rollerblading, skiing, snowboarding, or various other sporting adventures where there exists a risk of fatal or even minor injury through impacts to the head.

Early protective helmets were bulky and unattractive while providing minimal protection to the user due to the inability of manufacturers to construct a protective helmet having sufficient impact attenuation properties. While better than not wearing any protective helmet at all, these early helmets were subject to hairline fractures and significantly decreased impact attenuation properties upon a first impact, often resulting in the helmet having to be discarded.

In addition, these early protective helmets did not provide adequate means for ventilation, which would cause the user to perspire profusely and to lose critical energy. Moreover, designers and manufacturers of protective helmets wishing to implement some type of ventilation system into protective helmets were faced with the problem of maintaining the structural integrity of the helmet as it was often necessary to place apertures in the shell of the helmet itself to provide for ambient airflow and ventilation into the interior of the helmet.

As athletes and outdoor enthusiasts become more sophisticated, there is a corresponding increased demand for more sophisticated equipment. Users of protective helmets are continually seeking lighter, more aerodynamically configured helmets that provide maximum comfort and ventilation without sacrificing the ultimate in protective capabilities. In response, the design and manufacturing technology of protective helmets has undergone, and continues to undergo, significant changes. Advanced technology and manufacturing capabilities have led to advanced protective helmets having superior protective qualities and ventilation means or systems. Today's protective helmets are lighter, sleeker in appearance, and equipped with more sophisticated ventilation systems to provide the user greater ambient airflow into the interior of the helmet, all of this without sacrificing the structural integrity of the protective helmet.

For example, U.S. Pat. No. 6,105,176 discloses a bicycle helmet having a configured and situated front intake vent or a configured and situated rear exit port or exit ports, or both, such that the front vent and/or rear port or ports can provide for improved movement of air over the wearer's head while retaining sufficient structural integrity to provide adequate head protection. In one general aspect the invention features a bicycle helmet that includes a helmet body having a plurality of vents, including a front vent that is wider than high. In another general aspect, the invention features a bicycle helmet that includes a helmet body having a plurality of vents, including at least one rear exit port opening outward onto a surface that is below the most rearward margin of the helmet body. However, no means is provided for wherein the user may adjust the ventilation system to suit environmental needs or user preferences.

In another example, U.S. Pat. No. 6,061,834 discloses an air ventilation helmet having air conducting means formed inside the liner thereof. The air conducting means comprises several air conducting channels directed to the ventilation device. Hence, air can flow through the air ventilation device and into the helmet through the air ducts so as to provide good ventilation. The invention also discloses a device that can be rotated to the back to prevent cold air from flowing into the helmet in winter and to avoid water leakage when it rains. The air ventilation safety helmet comprises a molded helmet body defining a recessed interior for receiving therein the head of the user and an air funnel which is attached to the molded helmet by means of a rubber band, a spring, a screw, or the like. Further, directed to the air funnel, several air ducts are formed inside the liner of the molded helmet to allow air to flow there through. Although providing relatively good ventilation, this invention requires manually attaching an air funnel to the protective helmet to achieve the ventilation. This is cumbersome and time consuming and does not lend itself to adjustment of the ventilation, or specifically the air flow, during the sporting event or activity.

Accordingly, what is needed is a protective helmet having an improved ventilation system that is comfortable, and capable of meeting and/or exceeding minimum safety standards.

SUMMARY

Despite their significant improvements and advancements, as mentioned above, protective helmets continue to suffer from inadequate and often poor ventilation systems.

Therefore, an object of the preferred embodiments of the present invention is to provide a protective helmet that consists of a single integrated structure having an improved ventilation system therein.

Another object of the preferred embodiments of the present invention is to provide a protective helmet with an inner liner directly molded to or bonded to the outer shell and a ventilation system integrated therein.

Yet another object of the preferred embodiments of the present invention is to provide a protective helmet having a ventilation system that is adjustable according to user preference.

A further object of the preferred embodiments of the present invention is to provide a protective helmet having an interchangeable ventilation system.

A still further object of the preferred embodiments of the present invention is to provide a protective helmet having a ventilation system comprising a vent space that can be integrated into any one of the layers of the protective helmet.

An even further object of the preferred embodiments of the present invention is to provide a protective helmet having a ventilation system that incorporates one of the layers of the protective helmet as a component of the vent space and the ventilation system.

To achieve the foregoing objects, and in accordance with the invention as embodied and broadly described herein, the preferred embodiment of the present invention, and each of the variations of the preferred embodiment, features a lightweight protective helmet, with an outer shell and an inner liner that is directly molded or bonded to the outer shell thus forming a shell/liner composite, and an improved ventilation system and method for manufacturing the same.

The present invention comprises a unique vent space that is designed and intended to be defined by the parameters set by various portions of or removable pieces fitting with the protective helmet, or a combination of these. Specifically, the vent space may be designed to be defined by one or more constituent components making up the protective helmet, such as the outer shell or inner liner. Thus, the vent space may be defined by the outer shell serving as the upper or lower boundary of the vent space, or the vent space may be defined by the inner liner serving as the upper or lower boundary of the vent space, or a combination of these (e.g. the portion of the inner liner adjacent the outer shell serving as one boundary of the vent space and the inner portion of the outer shell of the helmet serving as the other boundary of the vent space). Or, the vent space may be entirely contained within either the outer shell or the inner liner such that a portion of these serve as both the upper or lower boundaries of the vent space. Or, the vent space may be designed to be defined by an independently created vent box that works in conjunction with either the inner liner or outer shell. Or, the vent space may be defined by a vent box in which the outer shell or inner liner serves as either the upper or lower boundary of the vent space. Or, the vent space may be defined by a removable piece that fits within and functions with a portion of the inner liner or outer shell to define the vent space, such as a separate removable impact absorbing piece serving as one boundary of the vent space that couples to a recessed portion of the inner liner serving as the other boundary of the vent space. Or, the vent space may be defined by the outer shell serving as one boundary and a second shell or attachable piece serving as another boundary of the vent space, or any combination of these, such as a vent box having one boundary defined by any one of the above described layers or components of the helmet.

The function of the vent space is to provide means for ventilating the protective helmet in various ways, such as by enclosing a displaceable vent shield within the vent space to control ambient air flow into and out of the helmet.

In a first, preferred, embodiment, the present invention features a protective helmet comprising an outer shell, an inner liner comprised of impact absorbing material that is directly molded or bonded to the outer shell, and a ventilation system incorporated with or contained within the shell/liner composite. The ventilation system is manufactured to be housed within the inner liner.

The ventilation system comprises a vent space defined by a vent box containing a vent shield that is attached to a fluid airflow actuator located on the outside of the outer shell via an elongated member. The vent box is formed to provide a volume of space wherein the vent shield may reside, thus allowing the vent shield to displace within the vent box. It should be noted, although one ordinarily skilled in the art will most likely recognize this as obvious, that the vent shield in each of the embodiments described herein may be designed to displace in various ways, such as by sliding, rotating, elevating, pivoting, or in any other known way. However, in this preferred embodiment, the vent shield displaces in a bi-directional sliding manner within the vent box. Also located on the vent box is a slotted portion that provides a guide for the elongated member to slide within. The slotted portion of the vent box corresponds to and is directionally positioned or aligned with a matching slotted portion located on the outer shell. In essence, the fluid airflow actuator, as attached to the outer shell, is capable of sliding bi-directionally within the slotted portion existing on the outer shell, which in turn causes the coupled vent shield to slide in a bi-directional manner within the vent box. Specifically, as the fluid airflow actuator is displaced, the elongated member coupling the fluid airflow actuator to the vent shield causes the vent shield to slide or displace accordingly along the slotted portion of the vent box. As one or a plurality of apertures or ventilation ports may exist within the outer shell, displacement of the vent shield functions to open, close, or partially close off the ventilation ports, and the resulting interior portion of the protective helmet, to the ambient air. In one embodiment, the protective helmet contains a plurality of ventilation ports, wherein two ports located in the front of the protective helmet serve as active vents and are the only ventilation ports modifiable via above described ventilation system.

To construct the protective helmet, an outer shell is manufactured. Prior to molding the inner liner to the outer shell, the vent box is constructed wherein an upper member is attached to a lower member, thus creating the volume of space or vent space sufficient to enclose a vent shield. The upper member comprises the above-mentioned slotted portion. The vent shield is placed between the upper and lower members prior to their attachment to one another. Either prior to or subsequent to molding, an elongated member is attached to the vent shield and is inserted into the slotted portion of the upper member. The upper member and lower member are then attached together to create the vent box, thus allowing the vent shield to be slidably coupled to the vent box as described. After correctly positioning the vent box with respect to the outer shell, either directly adjacent the outer shell or at a substantial distance from the outer shell so as to be fully encased by the inner liner, the inner liner is then molded to the outer shell, thus enclosing the vent box therein. The elongated member is subsequently attached to the fluid airflow actuator wherein the vent shield may be displaced accordingly over any number of ventilation ports as designed.

In a second, alternative embodiment, the protective helmet of the present invention comprises the shell/liner composite configuration, and a ventilation system integrated therein.

In this embodiment, the vent space is created or defined by any layer of the protective helmet, and does not necessarily have to comprise a separate and independently created vent box. Specifically, in this embodiment, the vent space may be created using one or more of the layers or component parts of the protective helmet to define the vent space. As stated above, the vent space may defined by a removable piece capable of fitting with or coupling to the impact absorbing inner liner, preferably where a recess in the liner exists. In this situation, the vent space would be defined by the outer removable piece and its coupling relationship to the inner liner. Likewise, the vent space may be defined entirely by the impact absorbing inner liner, wherein a space is made by providing opposing recessed sections entirely encased or enclosed within the impact absorbing inner liner.

Or, the vent space may be defined by the impact absorbing inner liner in its relationship with the outer shell, such that a space is created or made when the inner liner is molded to the outer shell, a portion of the outer shell forming the top boundary of the vent space, and a portion of the inner liner forming the lower boundary of the vent space. In this configuration, the portion of the inner liner defining the lower boundary of the vent space would most likely comprise a recessed portion. However, the outer shell is also contemplated to comprise a recessed portion defining the upper boundary. Either way, the vent space is defined using one or more of the components of the protective helmet. Those identified here are merely illustrative of a few possible configurations. Others are not specifically recited will be apparent to one skilled in the art and should be considered within the scope of the disclosure herein.

In a third, alternative, embodiment, the protective helmet of the present invention comprises the shell/liner composite configuration, and a ventilation system integrated therein.

In this embodiment however, the ventilation system may be outside or without the molded or shell/liner composite. The ventilation system may be directly coupled to the shell/liner composite, or an optional second, or outer, shell may be placed over the shell/liner composite, wherein the vent box, as described above in the first embodiment, may reside between the shell/liner composite and the second or outer shell. The vent box still comprises a volume of space housing a vent shield, wherein the vent shield is capable of displacing to cover one or more vent ports spaced at various positions around the protective helmet.

When the ventilation system is coupled directly to the shell/liner composite, the ventilation system may be coupled to the shell portion of the shell/liner composite, or the ventilation system may be adapted to fit within or interact with a recessed portion in the protective helmet. In addition, the ventilation system may be designed to be an interchangeable, self-contained ventilation system, or the ventilation system may employ one or more layers of the protective helmet, such as the outer shell, to form the vent box portion of the ventilation system. Moreover, the ventilation system may simply comprise a vent shield coupled directly to the shell portion of the shell/liner composite, either with or without the presence of a recessed portion.

When employing a second shell, the ventilation system, and particularly the vent box, is attached or coupled to the protective helmet and is encased between the shell/liner composite and the second shell. In this embodiment, the ventilation system functions similar to the embodiment as described above in that the vent shield employs means by which it may displace within the vent box, thereby allowing one or more vent ports to be open, closed, or partially closed to ambient air.

Also in this embodiment, the vent box may be formed from the individual helmet layers themselves to house the vent shield. For example, the second shell may form the upper plate of the vent box, or the shell/liner composite may serve as the lower plate of the vent box, or a combination of the two, such that an independent vent box having an upper and a lower plate is unnecessary. In this embodiment, the second shell or the shell/liner composite would be used as one of the upper or lower plate members, respectively, to form the volume of space housing the vent shield. In addition, it should be noted that any layer of the protective helmet may be used to form one or more of the plates making up the vent box, or the vent box may be housed in any one of the layers of the protective helmet.

In a fourth, alternative, embodiment, the present invention features the shell/liner composite protective helmet having an exterior ventilation system comprising various types of interchangeable insert members. In this embodiment, the protective helmet is similar to the helmet of the first embodiment described above where it comprises the shell/liner composite, with no second shell, and one or more vent ports located therein (to allow ambient air to enter the interior of the helmet if the port is left uncovered). Preferably however, the vent port is located in a recessed portion of the shell/liner composite portion of the protective helmet, wherein an interchangeable insert member is designed to fit. Interchangeable insert member may comprise a self-contained ventilation system (an active vent system), or a passive ventilation system, which is simply the vent port and no insert member, or an insert member that cuts off ambient airflow from entering the interior of the protective helmet altogether (a stopper insert member). Interchangeable insert members are removably coupled to the protective helmet using any known means, such as rivets, snaps, interference fits, retaining rails, tongue and groove, etc. Although insert members are preferably designed to fit within the recessed portion of the protective helmet, insert members may also be designed to fit from the inside of the protective helmet, wherein they may interact with the respective vent port. For example, a stopper insert member may be inserted into the recessed portion of the protective helmet from the outside, or may also be designed to interact with the vent port from inside the helmet.

To describe the interchangeable insert members further, in a preferred embodiment the self-contained ventilation system comprises a vent box defining the vent space discussed herein, a vent shield contained therein, and an actuator for causing the vent shield to displace bi-directionally within the vent box. The vent box is formed or designed to fit within the recessed portion of the protective helmet and to interact with the vent port. Simply stated, once the self-contained ventilation system, or vent box, is inserted into the recessed portion of the protective helmet, or coupled thereto if no recessed portion is used, an individual may control the amount of ambient airflow into the interior of the helmet by actuating the actuator and displacing the vent shield relative to the vent port, i.e., the vent port may be open, closed, or partially open to ambient air. If no insert member is used, the ventilation into the interior of the helmet becomes passive such that ambient air flows through the vent port uninhibited. Finally, interchangeable insert member may comprise a stopper or plug that may fit into the recessed portion that completely blocks ambient air from entering into the interior of the protective helmet through the vent port. This insert may be used in situations where it is imperative to retain as much body heat as possible, such as in cold weather situations. These insert members are intended to be interchanged at the will of the user with little or no effort.

A fifth, alternative, embodiment of the present invention is related to the fourth alternative embodiment and features a similar recessed portion manufactured into the shell/liner composite of the protective helmet. A vent port is also similarly located in the recessed portion as described above. However, in this embodiment, the recessed portion of the shell/liner composite is designed to serve as the lower plate or member of a vent box of the ventilation system. In this embodiment, an upper plate or member, preferably having similar dimensions as the recessed portion, is designed to couple to the recessed portion. Preferably the upper plate is designed to fit within the recessed portion. In addition, the upper plate is used in conjunction with the portion of the outer shell located within the recessed portion of the bonded shell/layer to create a vent box and a resulting vent space, or it is used in conjunction with a portion of the inner liner that may be exposed within the recessed portion to create a vent box and the resulting vent space. The resulting vent space or vent box contains or houses a vent shield that is coupled to an actuator. The vent box, vent shield, and actuator all function similarly to the vent box as described above to control ambient airflow through the vent port and into the interior of the protective helmet. As in embodiment three, the upper plate may be coupled to the protective helmet using any known means in the art. In addition, this embodiment could be manufactured where no recess exists in the shell/liner composite. In this case, the upper plate is coupled to the shell of the protective helmet which serves as the lower plate. In addition, the profile of the helmet would not be as clean and smooth as the vent system would protrude a distance from the rest of the shell.

In a sixth, alternative, embodiment, the present invention again features the shell/liner composite protective helmet, and a ventilation system. The ventilation system does not comprise an upper plate, but merely a vent shield, slidably coupled to the protective helmet, designed to displace over a vent port located in the protective helmet. The vent shield, in this particular embodiment, may be adapted for use with a protective helmet with no recessed portion, or the vent shield may adapted for use with a protective helmet comprising a recessed portion therein. The vent shield is coupled to the protective helmet using any known means to allow the vent shield to displace relative to the vent port, such that the vent port may be open, partially open, or closed to ambient air. The vent shield may also be coupled directly to the protective helmet, or the vent shield may be used in conjunction with an insert member that allows the vent shield to slide or displace.

Finally, a seventh, alternative, embodiment of the present invention features a shell/liner composite protective helmet, preferably comprising a recessed portion located therein, and a ventilation system. The ventilation system comprises a self-contained ventilation system as described in the above third embodiment, but including an additional element. The self-contained ventilation system of this embodiment comprises at least one releasable attachment point, wherein the ventilation system may swivel, rotate, and/or retract a substantial distance. In this respect, a portion of the ventilation system may be moved out of the way of the ventilation port and secured to another part of the shell of the protective helmet. The advantage of this embodiment is that the ventilation system is not required to be completely removed from the helmet, but may rather be relocated while still being coupled to the helmet. Of course, the ventilation system may also be completely removed if desired. However, when the ventilation system is simply relocated, the ventilation port functions passively to allow ambient air into the interior of the helmet. Alternatively, a stopper insert member may be inserted into the ventilation port to block airflow when the ventilation system is relocated or moved to a second position, or removed from the protective helmet altogether. Similarly, instead of a ventilation system being coupled to the protective helmet, a stopper or plug may be coupled to the helmet. The stopper may be used to either completely block access of ambient airflow into the interior of the helmet when the stopper is positioned over the ventilation port, or to allow for passive airflow if the stopper is relocated in a similar fashion as described above.

Each of the above-identified embodiments is discussed in detail below with their accompanying drawings.

BRIEF DESCRIPTION OF THE DRAWINGS

The foregoing and other objects and features of the present invention will become more fully apparent from the following description and appended claims, taken in conjunction with the accompanying drawings. Understanding that these drawings depict only typical embodiments of the invention and are, therefore, not to be considered limiting of its scope, the invention will be described and explained with additional specificity and detail through the use of the accompanying drawings in which:

FIG. 11-B illustrates the embodiment of the present invention in which the vent box and vent space is contained on or coupled to the exterior of the outer shell;

FIG. 12-B illustrates the embodiment of the present invention wherein the vent system is incorporated into the protective helmet on the exterior of the bonded shell and interior liner, and specifically, where a second shell serves as an upper plate of a vent box;

FIG. 14-B illustrates a vent shield placed within a recessed portion of the outer shell, wherein the vent space is defined by the recessed portion;

FIG. 14-C illustrates the embodiment of the present invention, wherein the ventilation system comprises a screen or filter system comprising a plurality of apertures therein to facilitate fluid flow;

FIG. 22-B illustrates a sectional side view of the embodiment described in FIG. 20-A, and the ability for the ventilation system to be relocated and releasably attached to another position on the helmet.

DETAILED DESCRIPTION OF THE PREFERRED EMBODIMENTS

Figure 1:
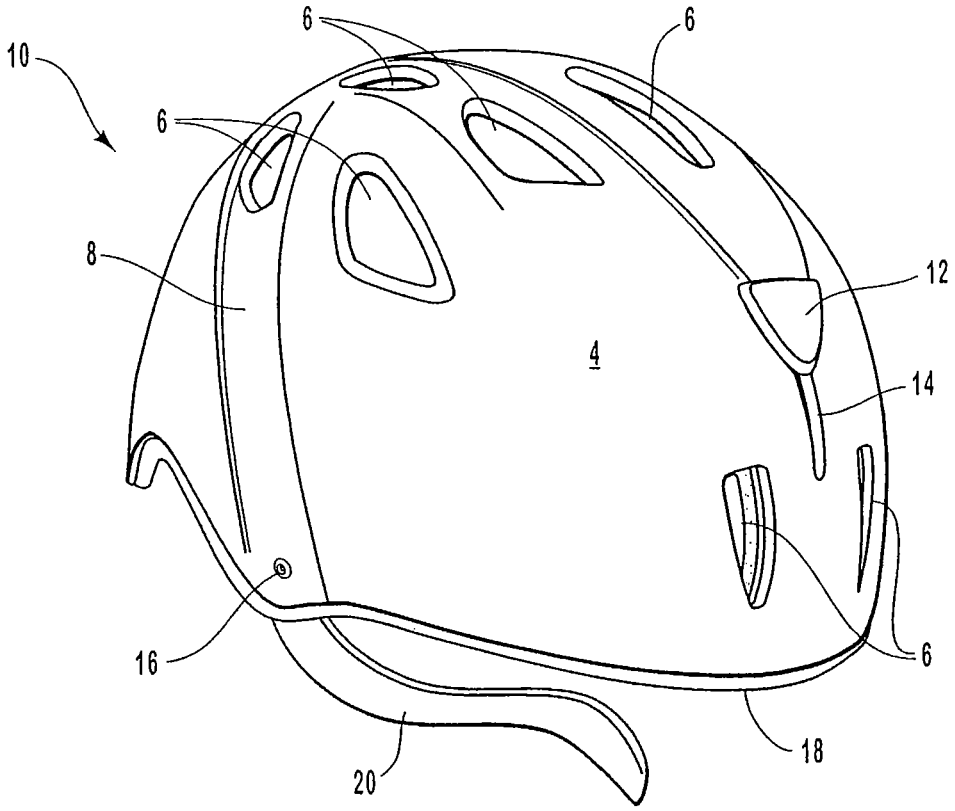
FIG. 1 illustrates the protective helmet with accompanying plurality of ventilation ports and fluid airflow actuator.

It will be readily understood that the components of the present invention, as generally described and illustrated in the figures herein, could be arranged and designed in a wide variety of different configurations. Thus, the following more detailed description of the embodiments of the system and method of the present invention, and represented in FIGS. 1 through 22-B, is not intended to limit the scope of the invention, as claimed, but is merely representative of the presently preferred embodiments of the invention.

The presently preferred embodiments of the invention will be best understood by reference to the drawings wherein like parts are designated by like numerals throughout.

The present invention features a protective helmet and improved ventilation control system. In the preferred embodiment, and preferably throughout each of the alternative embodiments discussed and described herein, the protective helmet comprises an inner liner joined to an outer shell. The inner liner may be bonded or molded to the outer shell to create a shell/liner composite. The inner liner is constructed or manufactured from impact absorbing material and provides the helmet its impact attenuation properties, which are designed to protect the wearer of the helmet from potentially dangerous impacts or blows to the head.

The present invention improved ventilation system focuses on the creation of a ventilation system comprised of a vent space created or defined by one or more constituent parts of the protective helmet, or by one or more removable insert pieces working in conjunction with one or more of the constituent parts of the protective helmet, or a combination of these. For example, the vent space may be created or defined by one or more constituent components making up the protective helmet, such as the outer shell or inner liner. Thus, the vent space may be defined by the outer shell serving as the upper or lower boundary of the vent space, or the vent space may be defined by the inner liner serving as the upper or lower boundary of the vent space, or a combination of these (e.g. the portion of the inner liner adjacent the outer shell serving as one boundary of the vent space and the inner portion of the outer shell of the helmet serving as the other boundary of the vent space). Various insert members may also be utilized that attach or couple to any part of either the inner liner or outer shell, including any recessed portions created therein.

The vent space may also be entirely contained within either the outer shell or the inner liner such that a portion of these serve as both the upper or lower boundaries of the vent space. For example, the inner liner may comprise or define the vent space by providing for an upper boundary of inner liner material to oppose a lower boundary of inner liner material, such that a volume of space is created within the inner liner defining the vent space.

Or, the vent space may be designed to be defined by an independently created vent box that works in conjunction with either the inner liner or outer shell. An independent vent box may be coupled directly to the outer shell, or the inner liner, and comprises upper and lower members that separate from outer shell or inner liner. Alternatively, the vent space may also be defined by a vent box, but wherein the vent box utilizes one or both of the outer shell or the inner liner to function or serve as either the upper or lower boundary of the vent space.

Still further, the vent space may be defined by a removable insert piece that fits within and functions with a portion of either the inner liner or outer shell to define the vent space. For example, a separate removable impact absorbing piece may be made to serve as one boundary of the vent space and that couples to or fits within a recessed portion of the inner liner serving as the other boundary of the vent space.

Finally, the vent space may be defined by the outer shell serving as one boundary and a second shell or attachable piece serving as another boundary of the vent space, or any combination of these, such as a vent box having a removable piece serving as one boundary and another boundary defined by any one of the above described layers or components of the helmet.

In each of these examples or embodiments, a vent space is created to house a vent shield capable of displacing therein to control ambient air flow in the helmet. These several examples or embodiments are not meant to be limiting in any way as one ordinarily skilled in the art will recognize other possible configurations or assemblies that fall within the scope of the invention as disclosed and claimed herein. Therefore, the following disclosure and accompanying description of Figures setting forth these several examples and other possible configurations or embodiments are intended only to be illustrative of a few of the possible embodiments achievable by the technology of the present invention.

FIGS. 1-9 show several variations of a first, preferred, embodiment of protective helmet 10. Specifically, FIG. 1 shows protective helmet 10 having a plurality of ventilation ports 6. Ventilation ports 6 are designed to facilitate ambient air flow into and out of the interior of protective helmet 10, and are shown as apertures that extend from the outer shell 4 through and into the interior of protective helmet 10. Protective helmet 10 is comprised of an outer shell 4 and an inner liner 18. Also shown is fluid airflow actuator 12 that is slidably coupled to protective helmet 10 and specifically outer shell 4 wherein fluid airflow actuator 12 is capable of sliding in a bi-directional manner along slotted portion 14. Slotted portion 14 therefore serves as a guide to fluid airflow actuator 12. As will be discussed in greater detail below, fluid airflow actuator 12 displaces, such that ventilation or air flow through ventilation ports 6 may be modified and controlled by the user. Air flow may be total, partial, or blocked. In its current position, as shown in FIG. 1, fluid airflow actuator 12 allows ambient air to flow through ventilation port 6. Upon displacing fluid airflow actuator 12 in a downward direction, the ambient air flow is blocked from entering ventilation port 6 using a vent shield, which is not shown in FIG. 1, but is described below. Attachment points or rivets 16 are also shown in FIG. 1 and are used to attach straps or other accessory items to protective helmet 10. Finally, FIG. 1 also shows a series of vent ports 6 positioned along the rear of helmet 10. These vent ports may serve as either intake or exhaust ports to allow air flow in and out of the interior of helmet 10 to cool the individual or to allow air and heat from the interior to escape, thus creating an increased efficiency cooling system.

Figure 2:
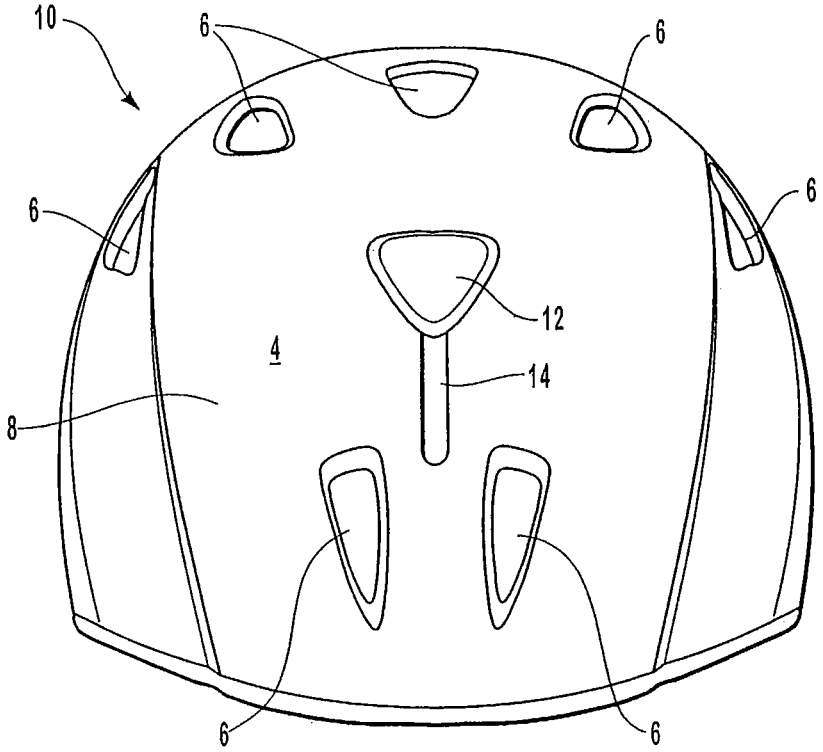
FIG. 2 illustrates a front view of the protective helmet having a series of symmetrically spaced ventilation ports and a forward facing fluid airflow actuator.

FIG. 2 shows a front view of protective helmet 10 and depicts the preferred embodiment of the present invention wherein ventilation ports 6 facilitate ambient air flow to the interior of protective helmet 10 through only the two front facing ventilation ports 6. Although the preferred embodiment includes a ventilation system that allows the user to only modify the air flow through the front facing ventilation port 6, this is not meant to be limiting in any way, as the ventilation system of the present invention may be designed to modify or adjust air flow through any or all of ventilation ports 6 incorporated within protective helmet 10.

Figure 3:
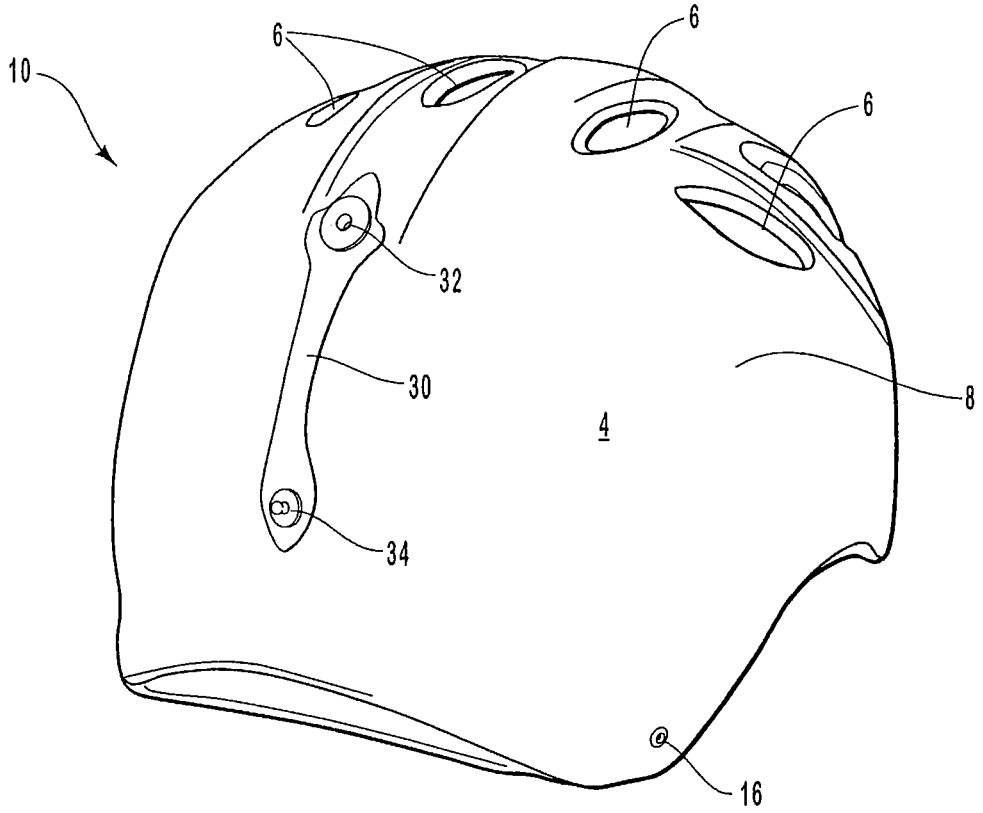
FIG. 3 illustrates a rear view of the protective helmet.

FIG. 3 shows a rear view of protective helmet 10 having an optional goggle strap holder 30 with an upper mounting point 32 and a lower mounting point 34. Also shown are ventilation ports 6 located at symmetrical locations along outer shell 4.

Figure 4:
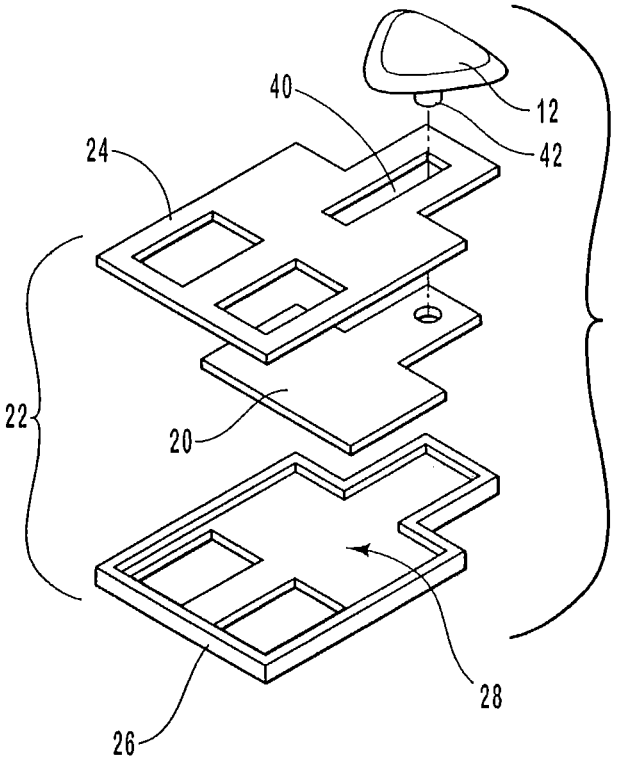
FIG. 4 illustrates a perspective view of the vent box having the vent shield contained therein.
Figure 5:
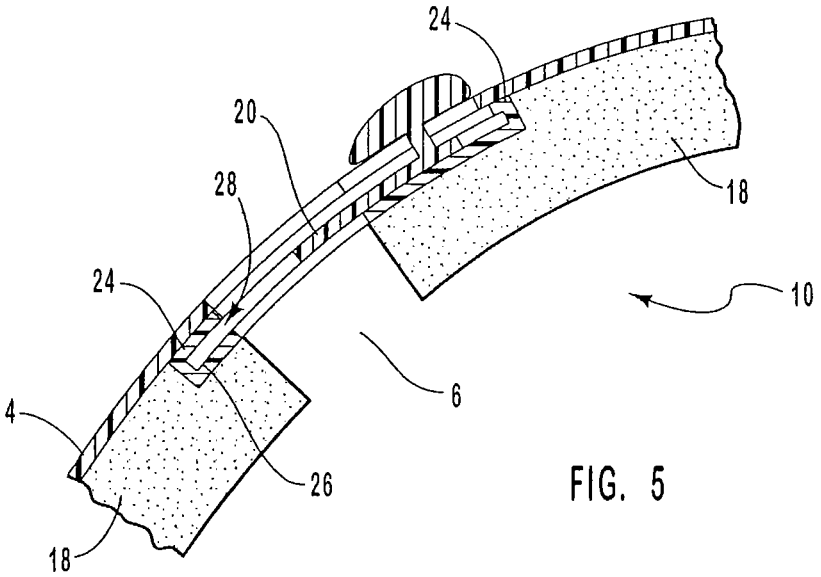
FIG. 5 illustrates a cut away side view of one embodiment of the protective helmet and vent system as integrated with the protective helmet.

FIGS. 4 and 5 serve to illustrate the relationship between each of the components that make up protective helmet 10. FIG. 4 shows vent box 22 comprising an upper portion and a lower portion defining vent space 28. Vent box 22, and particularly upper portion, is also shown having a slotted portion 40 therein that is to be positioned and aligned with slotted portion 14 located in outer shell 4, such that elongated member 42, which is attached to vent shield 20, may slide in a bi-directional manner within each respective slotted portion, thereby causing vent shield 20 to displace accordingly. Elongated member 42 has opposing ends. A first end is attached to vent shield 20 and a second end is attached to fluid airflow actuator 12. It should be noted that elongated member 42 and actuator 12 may be a single integrated piece rather than separate components, or elongated member 42, actuator 12, and vent shield 20 may also be a single integrated or formed piece.

Upon displacing fluid airflow actuator 12, vent shield 20 is also thereby caused to displace. This action allows the user of protective helmet 10 to lower or raise vent shield 20 over ventilation port 6 as desired. Ventilation port 6 may be totally covered by vent shield 20, or partially or totally uncovered thereby allowing ambient air to flow through ventilation port 6 into the interior of protective helmet 10.

FIG. 5 illustrates a cut away side view of another exemplary embodiment of the protective helmet and integrated ventilation system, wherein the vent space is located between the outer shell and the inner liner. In this embodiment, vent box 22 and associated vent space 28 is comprised of an upper member 24 and a lower member 26 embedded within a recess in an outer portion of liner 18 beneath outer shell 4. Upper and lower members 24 and 26 define the upper and lower surface or boundary of the vent box 22 and vent space 28, respectively. FIG. 5-B further shows vent shield 20 as it is encased within vent box 22 and vent space 28 that results from attaching upper member or plate 24 to lower member or plate 26. As mentioned above, vent shield 20 is able to slide or displace in bi-directional, circular, or other manner within vent box 22. As it does, vent shield 20 either covers, uncovers, or partially covers ventilation ports 6 to control the flow of ambient air into the interior of protective helmet 10.

The present invention features ventilation systems integrated into an in-molded protective helmet. To form protective helmet 10 according to the present invention, outer shell 4 is obtained and inner liner 18 is molded or bonded directly to outer shell 4, a process know as in-molding, meaning the outer shell is joined to the inner protective liner using a molding or bonding process, such that the two are not each first individually created, and later assembled together, but rather each are joined together initially as part of the same manufacturing process. Inner liner 18 comprises impact absorbing material serving as the protective element for protective helmet 10. In one embodiment, prior to molding inner liner 18 directly to outer shell 4, vent box 22 and vent space 28 is created to contain or house vent shield 20 therein. As stated, to form vent box 22, upper member 24 is formed with lower member 26 to create and define volume of space 28. Upper member 24 and lower member 26 may be planar (e.g. flat) or designed with varying radius' of curvature. In any event, upper member 24 and lower member 26 are to be formed, such that a volume of space 28 is created in which vent shield 20 may be housed. However, prior to attachment of upper member 24 to lower member 26, vent box 22, is situated therein such that vent shield 20 may displace, preferably in a bi-directional sliding manner, within vent box 22.

Once vent box 22 is formed, it may be positioned either directly adjacent outer shell 4 or it may be offset a substantial distance from outer shell 4. Slotted portion 40 in vent box 22 is always to align with slotted portion 14 in outer shell 4, with elongated member 42 protruding therefrom. Upon positioning vent box 22, inner liner 18 is then molded or bonded directly to outer shell 4 such that vent box 22 is entirely encased within inner liner 18. As mentioned above, inner liner 18 is comprised of an impact resistant material, preferably a material that is capable of being molded directly to outer shell 4. One ordinarily skilled in the art will recognize and understand that inner liner 18 can consist of any suitable material that is capable of providing sufficient impact attenuation properties to protective helmet 10, as well as alternative ways to manufacture protective helmet 10 in order to bond or mold liner 18 to shell 4 and to create vent space 28.

Figure 6:
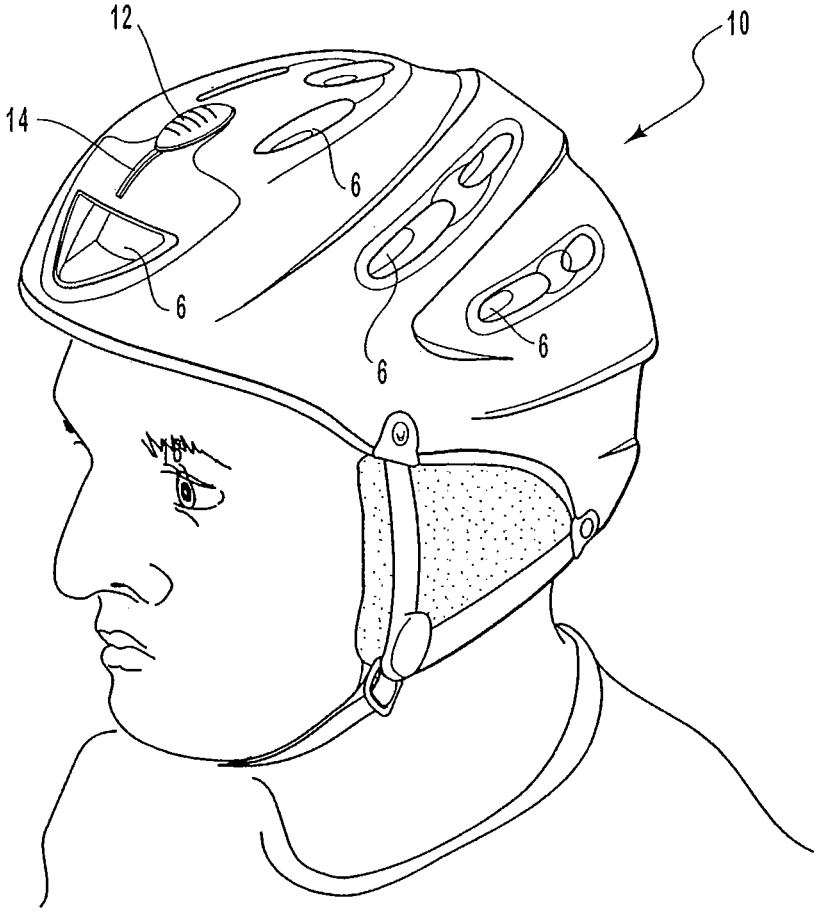
FIG. 6 illustrates the protective helmet of the present invention having a single large front vent controlled by an actuator.

FIG. 6 illustrates another configuration of this first embodiment of protective helmet 10, wherein protective helmet 10 has a single large front vent port 6 controlled by actuator 12.

Figure 7:
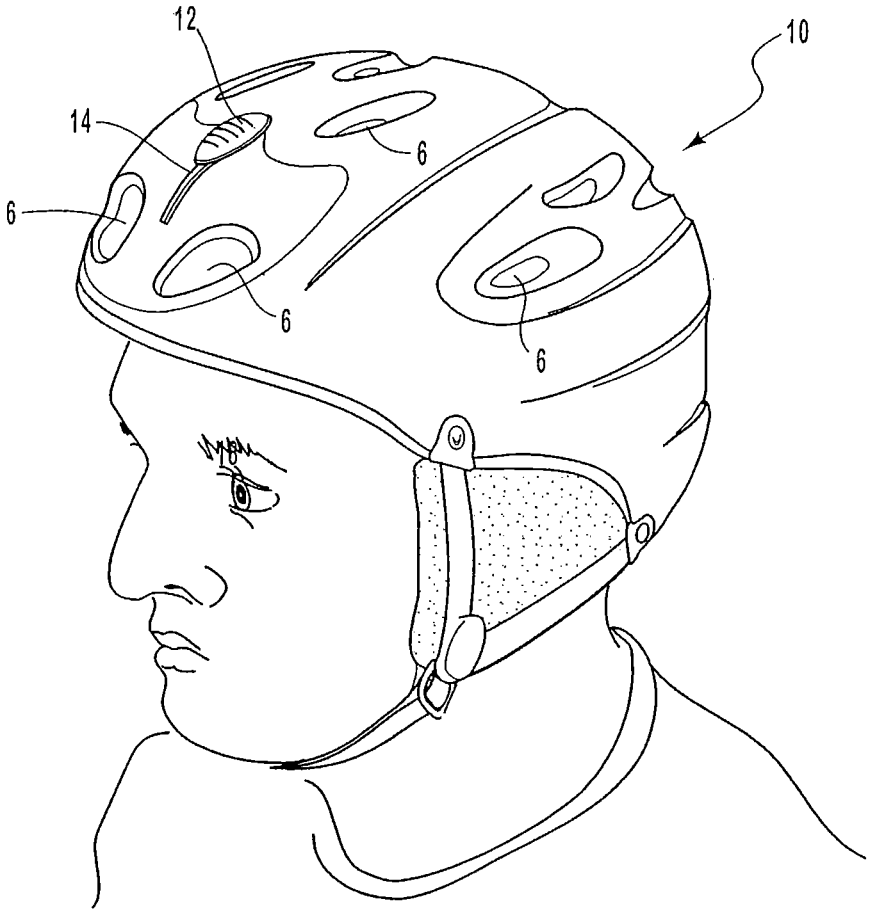
FIG. 7 illustrates the protective helmet of the present invention having a single actuator that controls two vent ports.

FIG. 7 illustrates another yet another configuration of this first embodiment of protective helmet 10, in which helmet 10 has a single actuator 12 that controls the flow of ambient air into two front vent ports 6.

Figure 8:
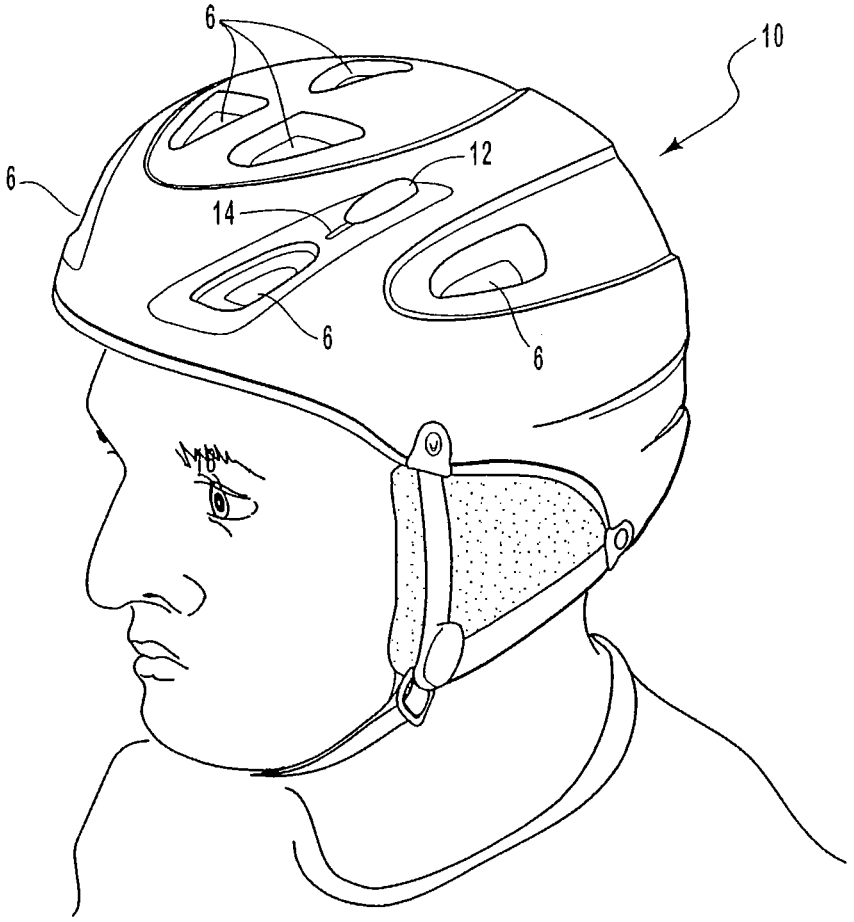
FIG. 8 illustrates the protective helmet of the present invention having two separate front vents and two actuators, both of which are independent vent systems of one another.

FIG. 8 illustrates still another configuration of this first embodiment of protective helmet 10, in which helmet 10 has two separate and independent front ventilation systems. The ventilation systems each comprise first and second vent ports, and first and second respective or corresponding actuators.

Figure 9:
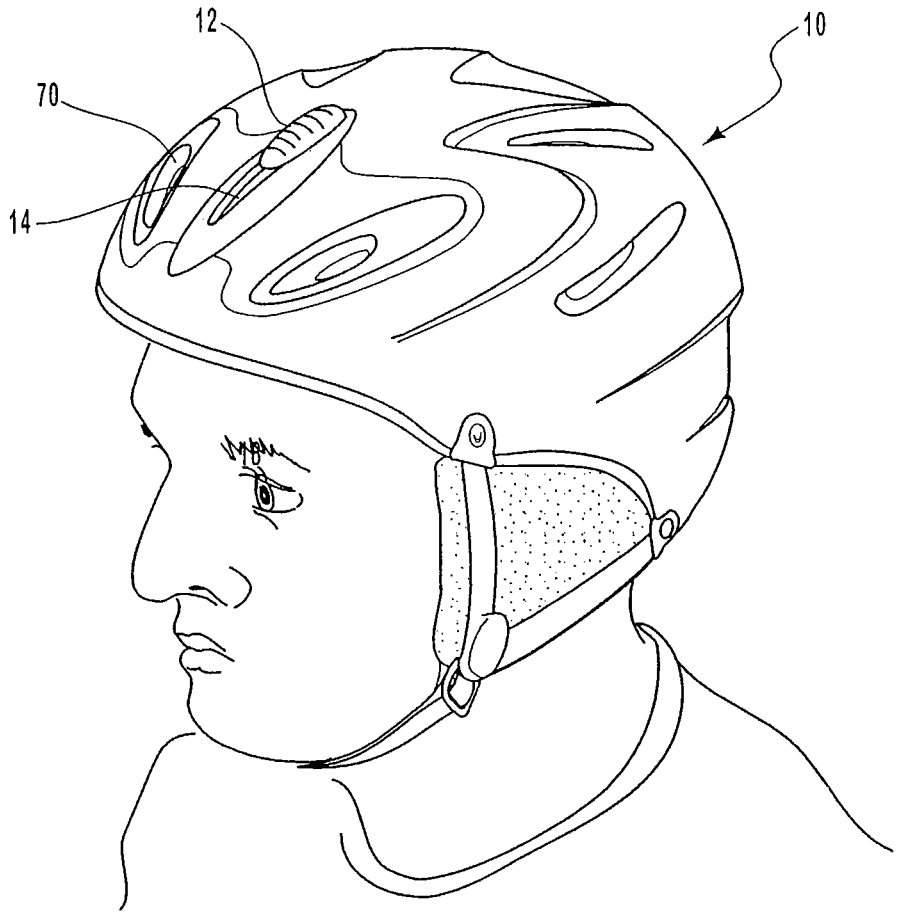
FIG. 9 illustrates the protective helmet of the present invention having aggressive raised intake busters.

FIG. 9 illustrates protective helmet 10 of the present invention having aggressive raised intake busters 70.

Figure 10:
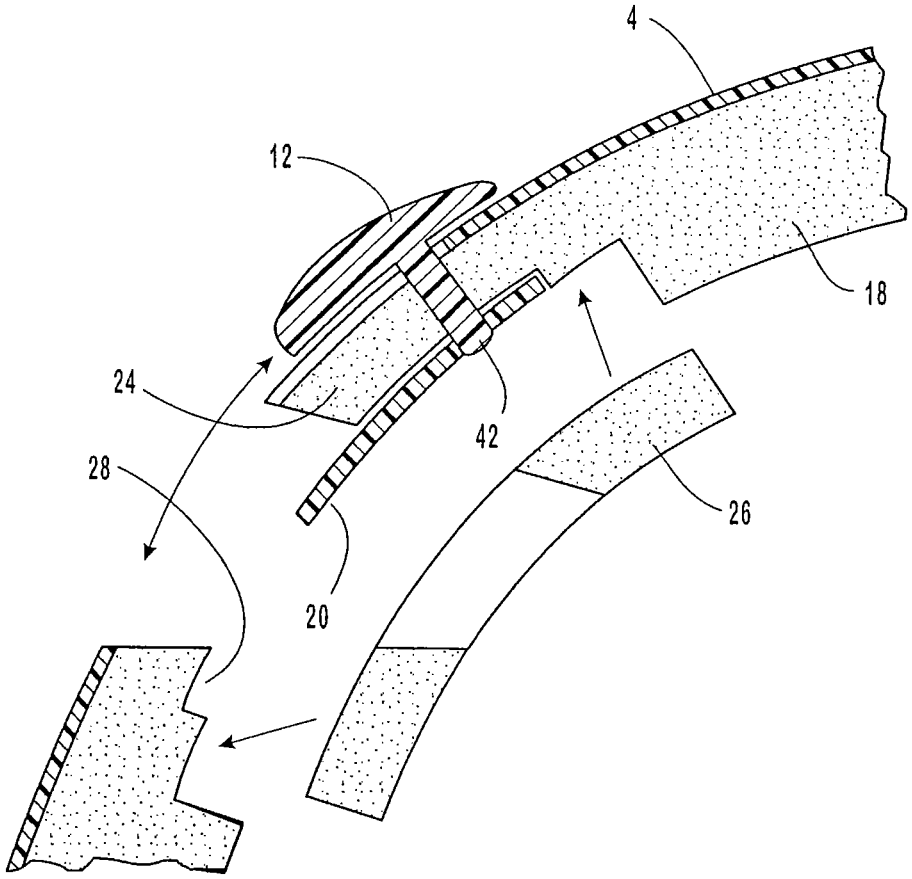
FIG. 10 illustrates a cut away front view of one embodiment of the protective helmet according to the present invention in which a removable absorbing material piece fits within a recess located in the inner liner in a matching relationship to create a vent space housing a vent shield.

FIG. 10 illustrates a second, alternative embodiment of the protective helmet of the present invention. Protective helmet 10 comprises outer shell 4 joined (molded or bonded) to liner 18. In this embodiment, it is contemplated that vent space 28 may be created within the component parts of protective helmet 10. Specifically, FIG. 10 depicts protective helmet 10 having a vent space 28 defined by a portion of impact absorbing inner liner 18 being removed to form a recess therein, such that inner liner 18 forms the upper boundary of vent space 28. Removable insert member 26 is designed to fit within the recess in liner 18 as indicated by the arrows, but insert member 26 is also removable, thus allowing the user to place or displace insert member 26 as desired. Insert member 26 is comprised of a similar size and shape as the recess formed within liner 18 that receives insert member therein to enclose vent shield 20 and define vent space 28. Insert member 26 may comprise various material compositions, but is preferably the same or a similar impact absorbing material as liner 18. Moreover, insert member 26 may be fittable within or attached to liner 18 using any known means in the art, such as an interference fit, a hook and loop fastening system, threaded members (screws or thumb screws), tongue and groove system, and others.

As shown, removable insert 26 comprises a similar shape as the recess portion of inner liner 18, such that removable insert 26 may fit within inner liner 18 to form an integrated whole. However, removable insert 26 is not sized to fill the entire recessed portion of inner liner 18 in order to allow for and provide for the creation of vent space 28. As such, removable insert 26 forms the lower boundary of vent space 28. As removable insert 26 is fit within the recess of and coupled to inner liner 18, vent space 28 is created.

Other embodiments are also contemplated wherein vent space 28 may created or defined by any layer of the protective helmet, thus, not necessarily having to comprise a separate and independently created vent box as in the first embodiment described above. For example, vent space 28 may be created and defined using one or more of the layers or component parts of the protective helmet, such as entirely defining vent space 28 with inner liner 18, wherein a space is made by providing opposing recessed sections entirely encased or enclosed within inner liner 18. In this situation, inner liner 18 would comprise both the upper boundary and the lower boundary of vent space 28, such that vent space 28 is essentially a pocket of space or volume of space existing within inner liner 18. In this version, vent shield 20 would most likely be inserted during the molding phase of manufacture.

Another version of embodiment two may comprise vent space 28 being defined by inner liner 18 in its relationship with the outer shell, such that a space is created or made when inner liner 18 is molded to outer shell 4, wherein a portion of outer shell 4 forms the upper boundary of vent space 28, and a portion of inner liner 18 forms the lower boundary of vent space 28. In this configuration, the portion of inner liner 18 defining the lower boundary of vent space 28 would most likely comprise a recessed portion. However, outer shell 4 is also contemplated to comprise a recessed portion defining the upper boundary. Either way, the vent space is defined using the inner liner and outer shell components of protective helmet 10.

The examples identified herein are merely illustrative of a few possible configurations. Others are not specifically recited will be apparent to one skilled in the art and should be considered within the scope of the disclosure herein.

Figure 11A:
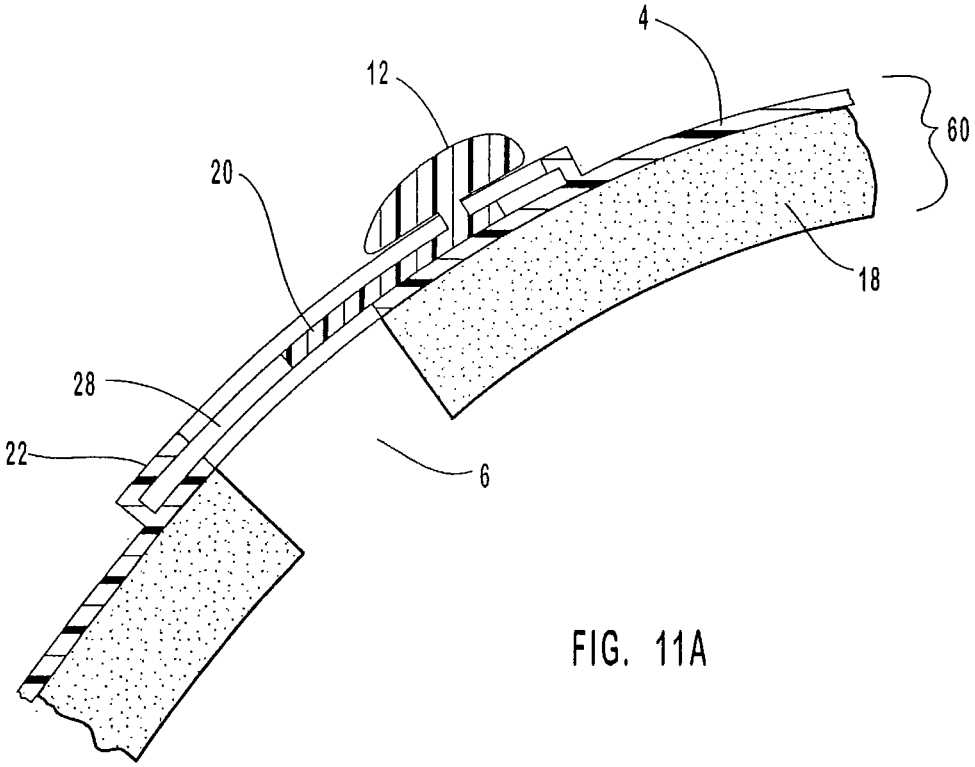
FIG. 11-A illustrates the protective helmet of the present invention wherein the ventilation system comprises a vent box or vent space in which the outer shell serves as the bottom portion of the vent space or vent box.
Figure 11B:
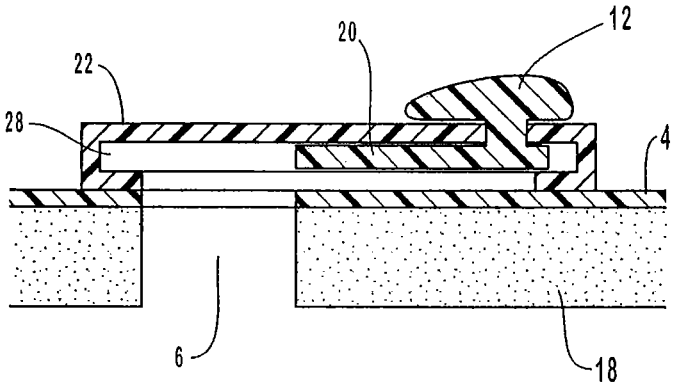
Figure 12A:
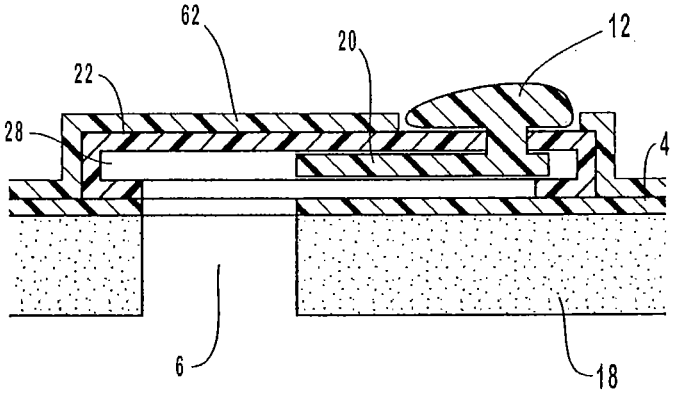
FIG. 12-A illustrates the embodiment of the present invention wherein the vent system and vent box is enclosed between the outer shell and a second shell on the exterior of the bonded shell and interior liner.
Figure 12B:
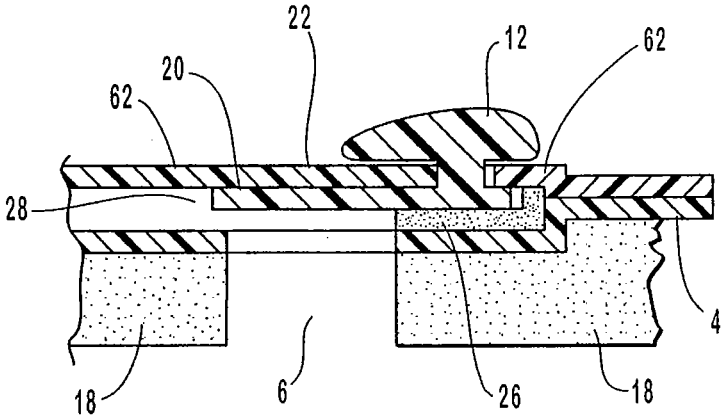
Figure 13:
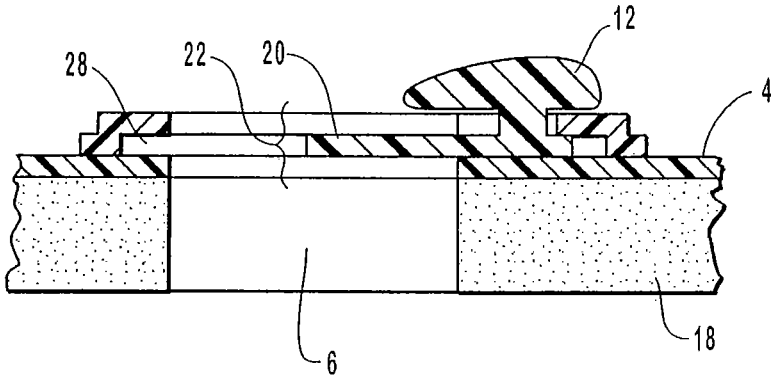
FIG. 13 illustrates the embodiment of the present invention wherein the vent system is incorporated into the protective helmet on the exterior of the bonded shell and interior liner, and specifically, where the shell of the shell/liner composite serves as the lower plate of a vent box.

FIGS. 11-13 are illustrative of variations of a third, alternative, embodiment of the protective helmet of the present invention. Specifically, FIG. 11-A depicts protective helmet 10 in alternative form, wherein the vent system is outside or without molded or shell/liner composite, together shown as 60, but is still integrated into protective helmet 10. Protective helmet 10 still comprises an inner liner 18 that is bonded or molded to an outer shell 4, together shown as molded or shell/liner composite 60.

Referring to FIGS. 11-A and 11-B, vent box 22, as described above, is coupled directly to the shell/liner composite 60. Vent box 22 defines vent space 28. When the ventilation system is coupled directly to the shell/liner composite 60, the ventilation system may be coupled to shell 4 portion of shell/liner composite 60 as shown in FIG. 11-B, or the ventilation system may be adapted to fit within or interact with a recessed portion existing within protective helmet 10 (not shown). In addition, the ventilation system may be designed to be an interchangeable, self-contained ventilation system, or the ventilation system may employ one or more layers of the protective helmet, such as the outer shell, to form the vent box portion of the ventilation system. Moreover, the ventilation system may simply comprise a vent shield coupled directly to the shell portion of the shell/liner composite, either with or without the presence of a recessed portion. Each of these variations will be obvious to one ordinarily skilled in the art and should not be construed as limiting to what is specifically described herein.

Referring to FIGS. 12-A and 12-B, vent box 22 is contained within an optional second shell 62 that may be coupled to the protective helmet and that is without or outside shell 4. As shown in FIG. 12-A, encased between, or contained within, shell 4 and optional second shell 62 is the ventilation system as described above except that vent box 22 is attached to helmet 10 between shell 4 and second shell 62. In this respect, vent box 22 is separated from inner liner 18, and may be accessed simply by removing second shell 62 if necessary. Both second shell 62 and vent box 22 may be coupled to protective helmet 10 using any known means in the art, and second shell 62 is optionally removable from protective helmet 10. Vent box 22 serves to house vent shield 20 within volume of space 28, and the resulting ventilation system functions similarly to the ventilation system described in FIGS. 1-9 above, except that the ventilation system is exterior to the shell/liner composite configuration. It should be noted that optional second shell 62 and vent box 22 may possess impact resistant properties, but these are not the primary source for protecting the user. As in all embodiments of the protective helmet described herein, impact resistant properties are primarily intended to be characteristic of inner liner 18.

FIG. 12-B shows a variation on this third embodiment to protective helmet 10. Specifically, second shell 62, as described above, may serve as the upper member or plate of vent box 22, such that second shell 62 and lower member 26 define volume of space 28. As vent box 22 is comprised of a lower plate and an upper plate, the inside surface of second shell 62 defines the upper plate of vent box 22, thereby also creating volume of space 28, wherein vent shield 20 may be housed. The displacing of vent shield 20 may be controlled by the wearer, such that any vent ports may be open, partially open, or closed to the flow of ambient air much the same way as described above. Attachment of vent box 22 and second shell 62 may be by any known means.

FIG. 13 shows yet another variation of this third embodiment of the present invention. Specifically, shell 4 may serve as the lower member or plate of vent box 22 of the ventilation system and the upper member or plate may be comprised of a removable piece capable of coupling to outer shell 4 and creating vent space 28 wherein vent shield 20 may be housed as shown. Again, the displacing of vent shield 20 may be controlled by the wearer, such that vent ports 6 may be open, partially open, or closed to the flow of ambient air much the same way as described above.

Again, it should be noted that vent box 22 or volume of space 28 of the present invention may be comprised of any one or more of the layers of the protective helmet, or may be a single independent entity located within any one of or between any two layers of the protective helmet. In addition, each of these embodiments may be used such that the ventilation system comprises a plurality of vent boxes and vent shields to control one or more vent ports, or a single vent box wherein the vent shield contained therein controls several vent ports.

Figure 14A:
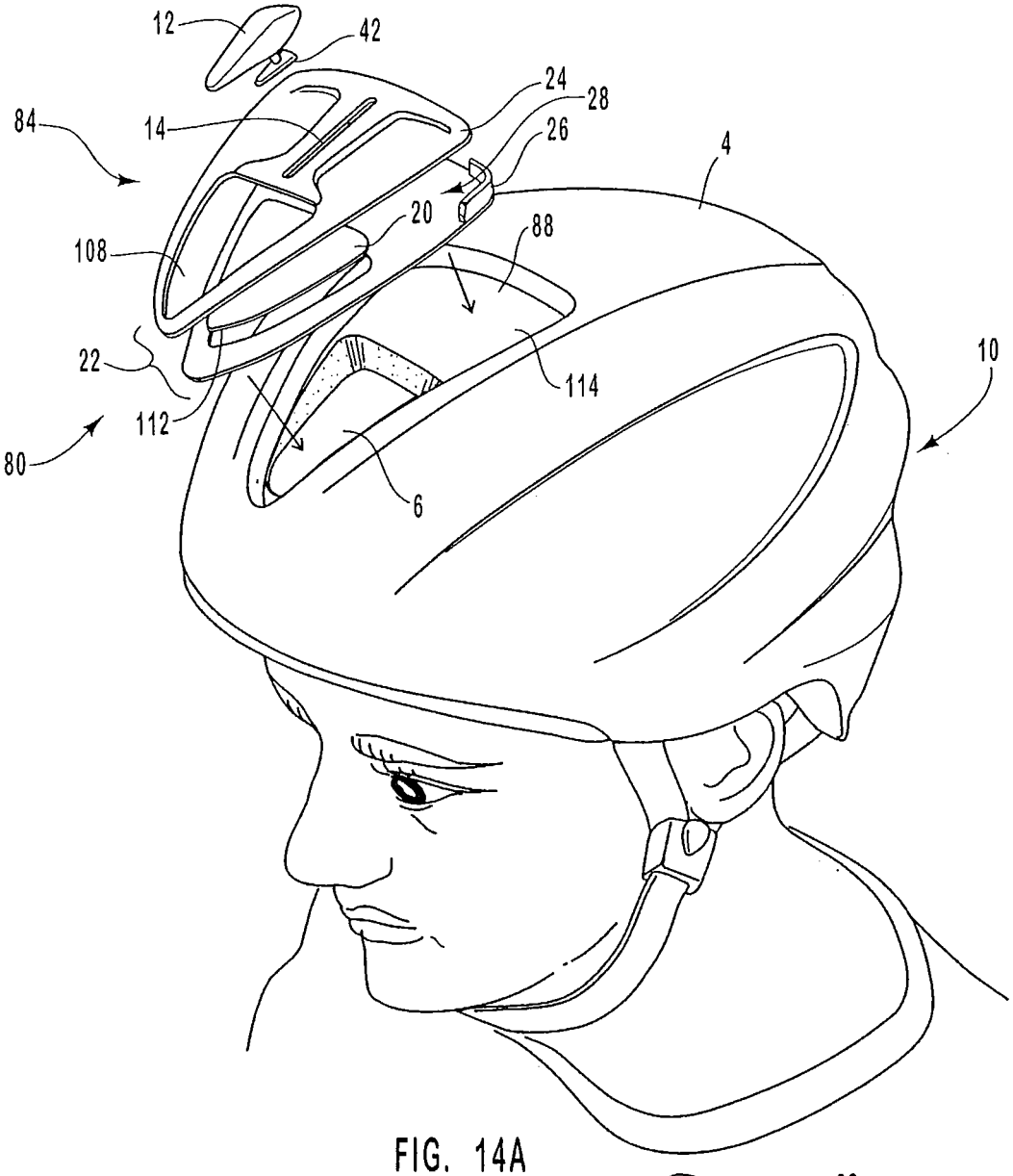
FIG. 14-A illustrates the embodiment of the protective helmet having interchangeable insert members, specifically what is shown is an interchangeable insert member comprised of a vent system having a vent space removably coupled to a recessed portion in the shell/liner composite.
Figure 14B:
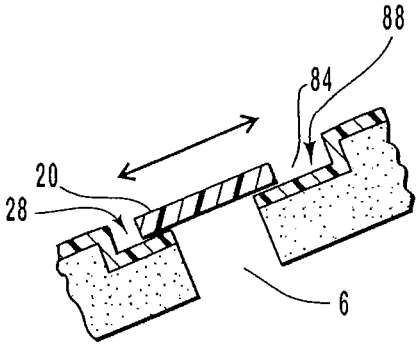
Figure 14C:
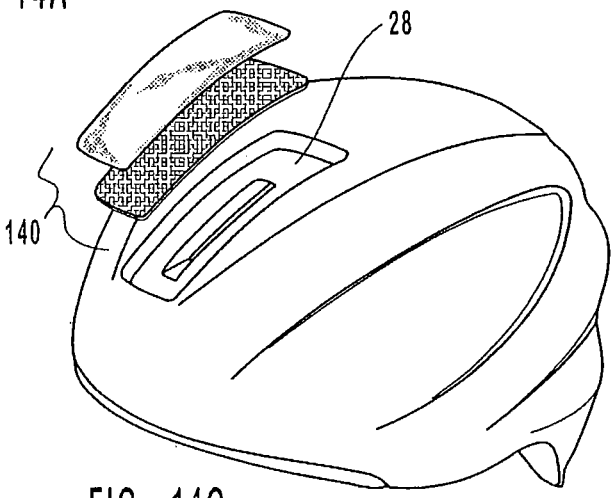

FIGS. 14-A to 14-B are illustrative of a fourth, alternative, embodiment of the protective helmet of the present invention. Referring to FIG. 14-A, the present invention features the shell/liner composite protective helmet 10 having an exterior ventilation system 80 comprising various types of interchangeable insert members 84. In this embodiment, protective helmet 10 is similar to the helmet of the first embodiment, described above, where it comprises the shell/liner composite, with no second shell, and one or more ventilation ports 6 positioned or spaced at various locations therein (to allow ambient air to enter the interior of the helmet if desired). In this preferred embodiment, vent port 6 is located in an internal recessed portion 88 of shell/liner composite portion of protective helmet 10, wherein interchangeable insert member 84 is designed to fit. Interchangeable insert member 84 may comprise a self contained ventilation system (an active vent system), or a passive ventilation system, which is simply the vent port and no insert member, or an insert member that cuts off ambient airflow from entering the interior of the protective helmet altogether (a plug, or stopper insert member).

To describe interchangeable insert members 84 further, FIG. 14-A is provided to show interchangeable insert member 84 as a self-contained ventilation system comprising a vent box 22 defining a vent space 28 therein, a vent shield 20 contained within vent space 28 and vent box 22, an actuator 12 designed to cause vent shield 20 to displace bi-directionally within vent space 28 and vent box 22, and a slotted portion 14, wherein elongated member 42 may be inserted within to couple vent shield 20 to actuator 12. Slotted portion 14 also serves as a guide for elongated member 42. Vent box 22 is similar to the vent box described above in that it comprises an upper plate member 24 and a lower plate member 26, which form to create volume of space 28 wherein vent shield 20 may be housed. Upper plate member 24 contains slotted portion 14 and an aperture 108. Aperture 108 allows ambient air to flow through upper plate member 24. Activating actuator 12 causes vent shield 20 to displace, wherein a wearer of the protective helmet may control ambient airflow into the interior of the helmet through vent port 6.

Interchangeable insert member 84 is designed and formed to fit within recessed portion 88 of protective helmet 10 and to interact with at least one vent port 6. Once self-contained ventilation system (or interchangeable insert member) 84 is inserted into recessed portion 88 of protective helmet 10, or coupled thereto if no recessed portion is used, an individual may control the amount of ambient airflow into the interior of the helmet by activating actuator 12, and displacing vent shield 20 relative to vent port 6. Specifically, in an open position, vent shield 20 is displaced such that ambient air may pass through aperture 108 in upper plate member 24, and aperture 112 in lower plate member 26, and subsequently through vent port 6 and into the interior of helmet 10. In a closed position, vent shield 20 is displaced such that ambient air is not allowed to flow through into the interior of protective helmet 10. Vent shield 20 may also be partially displaced, thus allowing variable amounts of ambient air into the interior of helmet 10 depending upon the desire of the wearer. Simply stated, vent port 6 may be open, closed, or partially open to ambient air depending upon the relative position of vent shield 20 with respect to vent port 6.

FIG. 14-B simply shows an interchangeable insert member comprising vent shield 20 as it is adapted to fit within recessed portion 88 without employing the use of an upper or lower member to create a vent box. However, vent space 28 still exists and is shown as recess 88. In this embodiment, it is apparent that vent space 28 does not require an upper and lower boundary, but may be open as shown. Vent space 28 is still capable, however, of housing vent shield 20 therein.

In a variation of this embodiment, if no insert member is used, the ventilation into the interior of the helmet becomes passive such that ambient air flows through vent port 6 uninhibited. In another variation, interchangeable insert member 84 may comprise a stopper or plug that may fit into the recessed portion that completely blocks ambient air from entering into the interior of protective helmet 10 through vent port 6. This insert may be used in situations where it is imperative to retain as much body heat as possible, such as in cold weather situations.

Finally, interchangeable insert member may be comprised of a screen or filter system 140 to fit within vent space 28, as shown in FIG. 14-C, having a plurality of ported apertures, such as a series of louvers. The screen or filter system is designed to facilitate either the removal of air from the interior of protective helmet 10, or to direct air into the interior of protective helmet 10, or a combination of these. This is accomplished as a result of the ported apertures, and their corresponding topside openings being formed on an angle from a perpendicular axis, either towards or away from the front of the helmet, respectively.

Interchangeable insert members 84 are removably coupled to protective helmet 10 using any known means, such as rivets, snaps, interference fits, retaining rails, tongue and groove, etc. In addition, these insert members are intended to be interchanged at the will of the user with little or no effort. Interchangeable insert member 84 is shown in FIGS. 14-A to 14-B as coming to rest upon ridge or shelf 114 of recessed portion 88. As such, insert member 84 may be attached to recessed portion 88 using screws, snaps, etc. One ordinarily skilled in the art will recognize that attachment of insert member 84 to recessed portion 88 of helmet 10 may be accomplished using several different means.

Figure 15:
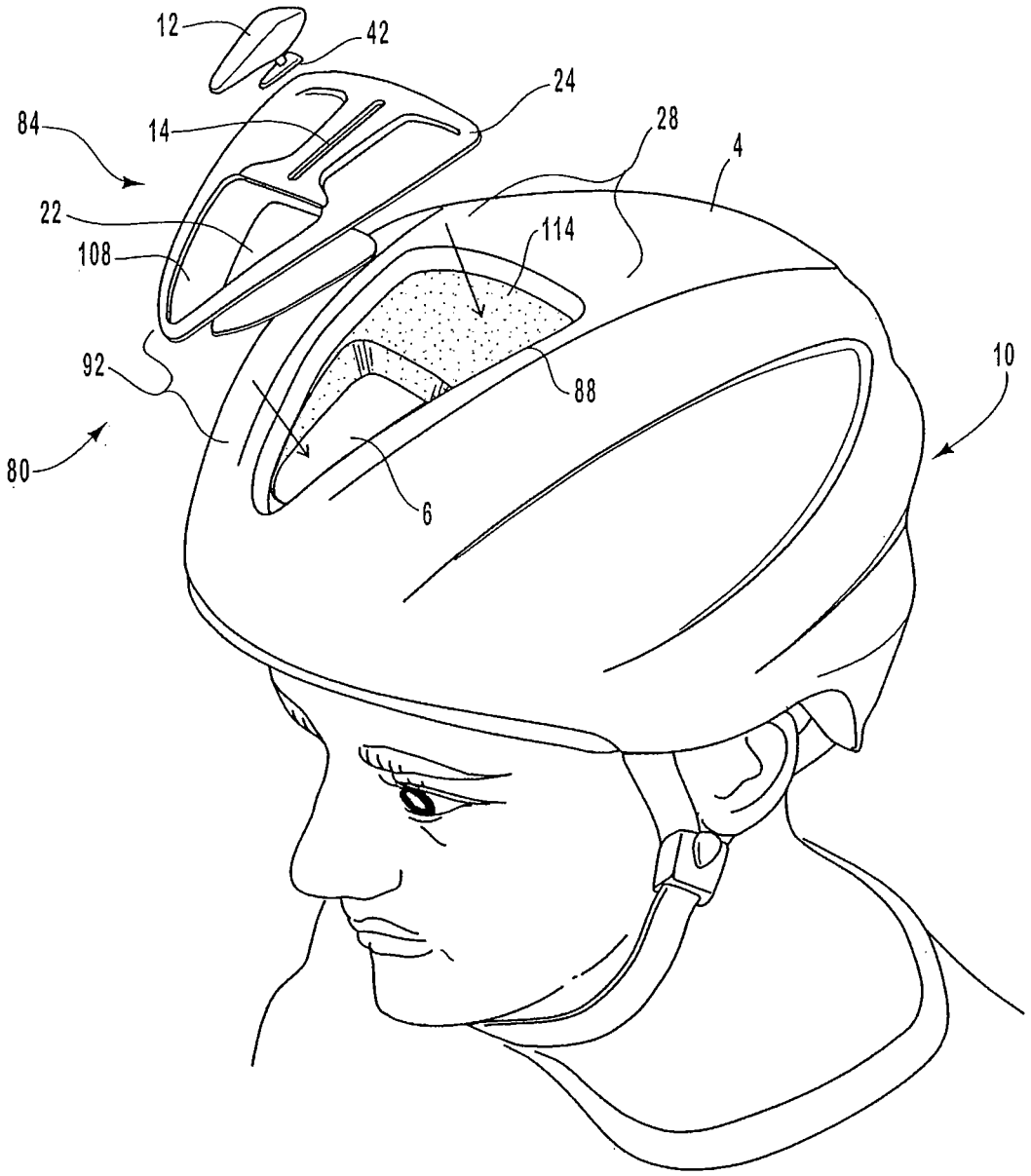
FIG. 15 illustrates the embodiment of the protective helmet where an upper or second plate or piece, in conjunction with the shell of a recessed portion of the shell/liner composite, forms a ventilation system and a vent space.

FIG. 15 is illustrative of a fifth, alternative, embodiment of the protective helmet of the present invention. This embodiment is related to the fourth embodiment, and features a similar recessed portion 88 manufactured into the shell/liner composite of protective helmet 10. A vent port 6 is also similarly located in recessed portion 88 as described above. Ventilation system 80 is also incorporated into the design of helmet 10. However, in this embodiment, recessed portion 88 of the shell/liner composite is designed to serve as a lower plate or portion of a vent box 22. In this embodiment, an upper plate 106, having similar dimensions as recessed portion 88, is designed to fit within recessed portion 88. In addition, upper plate 24 is used in conjunction with recessed portion 88 of the bonded shell/layer, particularly shelf 114 of outer shell 4, to create vent box 22. However, shelf 114 may be comprised of inner liner 18 rather than outer shell 4. The resulting vent box 22 and vent space 28 contains or houses vent shield 20 that is coupled to an actuator 12 via elongated member 42. Vent box 22, vent shield 20, and actuator 12, all function similarly to the vent box as described above to control ambient airflow through vent port 6 and into the interior of protective helmet 10. As in embodiment three, upper plate 24 may be coupled to protective helmet 10 using any means known in the art.

As a variation to this embodiment, protective helmet 10 could be manufactured where no recess exists in the shell/liner composite. In this case, upper plate 24 is coupled to shell 4 of protective helmet 10, which still serves as the lower plate to vent box 22. In this variation, the profile of helmet 10 would not be as clean and smooth as the vent system would protrude a distance from the rest of the shell.

In addition, and also similar to the previous third embodiment, ventilation system 80 can be attached to protective helmet 10 using any known means in the art.

Figure 16:
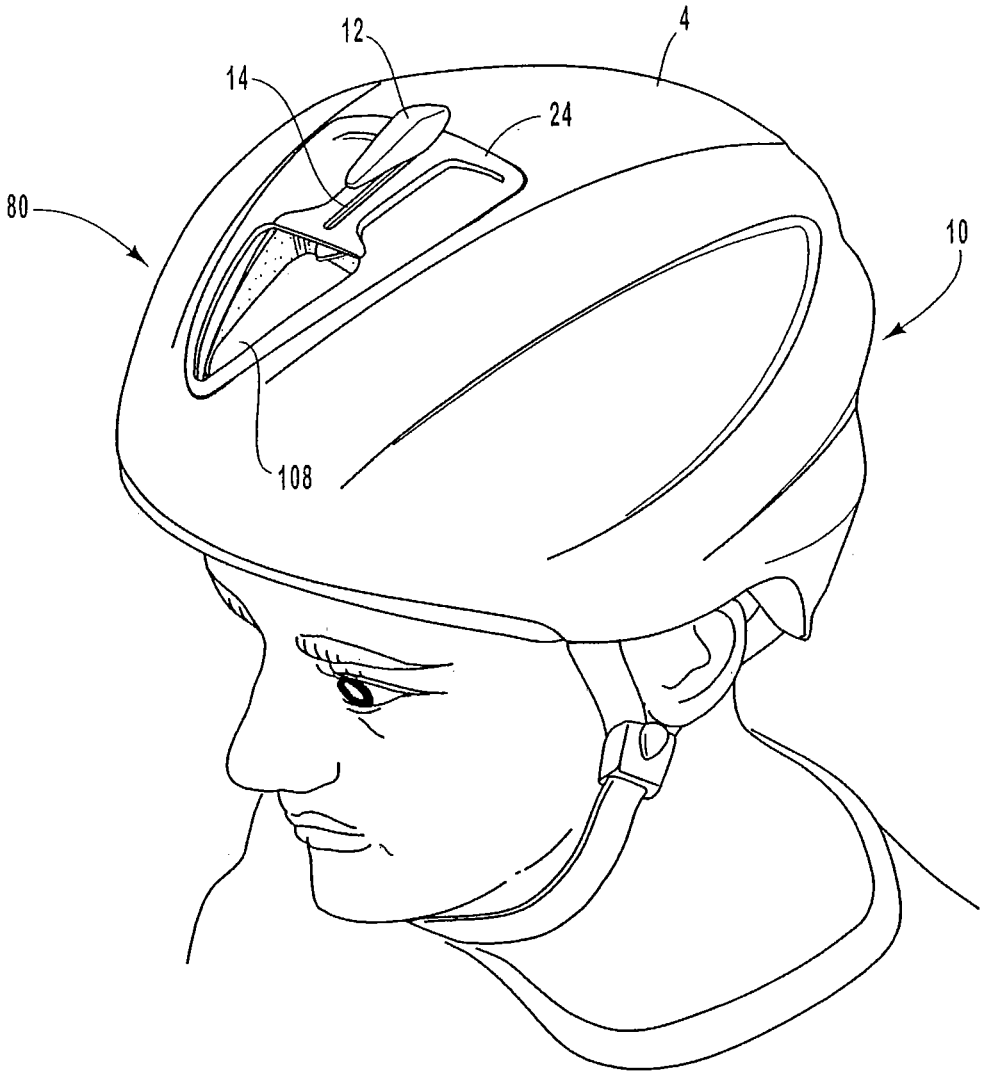
FIG. 16 illustrates both the embodiments in FIGS. 14 and 15 in a working, functional position within the protective helmet.

FIG. 16 illustrates ventilation system 80 as it is contained within, or coupled, to protective helmet 10. In this position, ventilation system 80 is fully functional in regulating ambient air flow through ventilation port 6 (not shown). FIG. 16 depicts either of embodiments four and five, as described above, in their functional and inserted position. Specifically, upper plate member 24 is shown to be substantially flush with shell 4 as upper plate member 24 is fit within recessed portion 88 (also not shown). To activate ventilation system 80, the wearer simply reaches up and activates actuator 12, such that it displaces in a direction along slotted portion 14, thus causing vent shield to likewise displace to a desired location.

Figure 17:
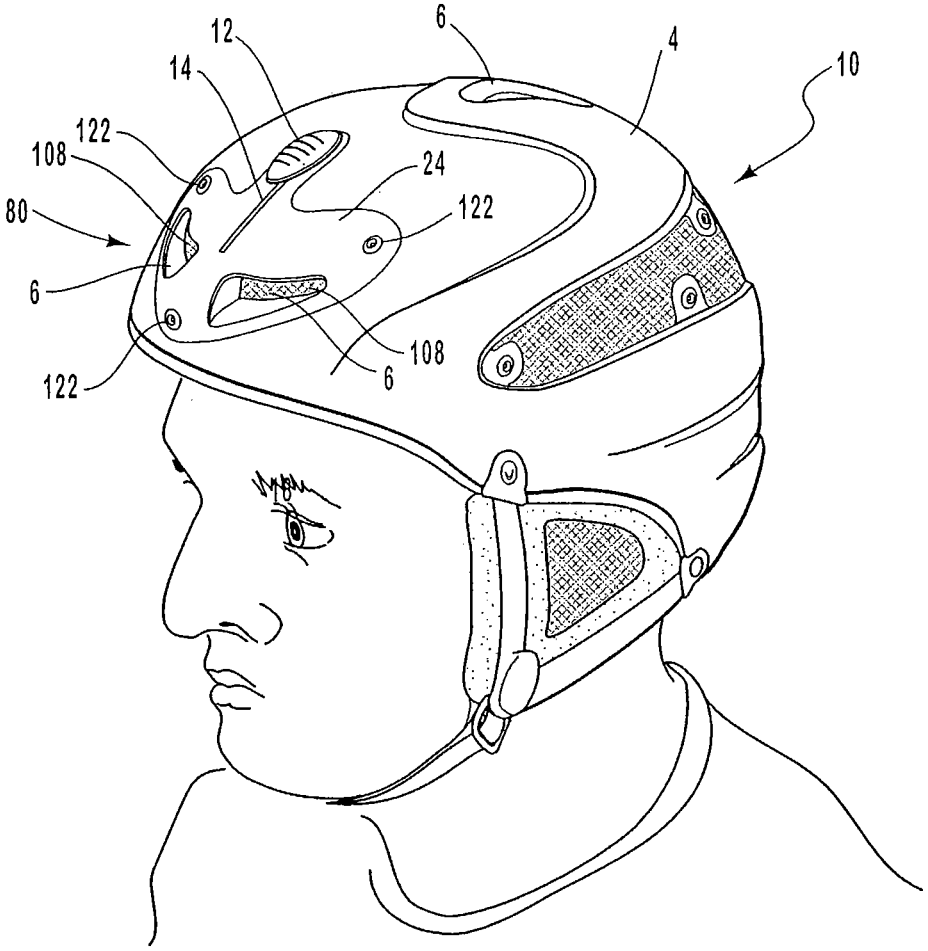
FIG. 17 illustrates the vent system attached to the protective helmet using rivets.

FIG. 17 illustrates a similar situation as FIG. 16, only the ventilation system is shown in a functional position as it is coupled directly to shell 4, and not fitted into a recessed portion within protective helmet 10. FIG. 17 also shows how upper plate member 24 is coupled to shell 4 of protective helmet 10, in this case using rivets 122. Also, ventilation system 80 is used to regulate air flow through two apertures 108, and corresponding vent ports 6, using a single vent shield (not shown) coupled to actuator 12 and associated control mechanism (also not shown).

Figure 18A:
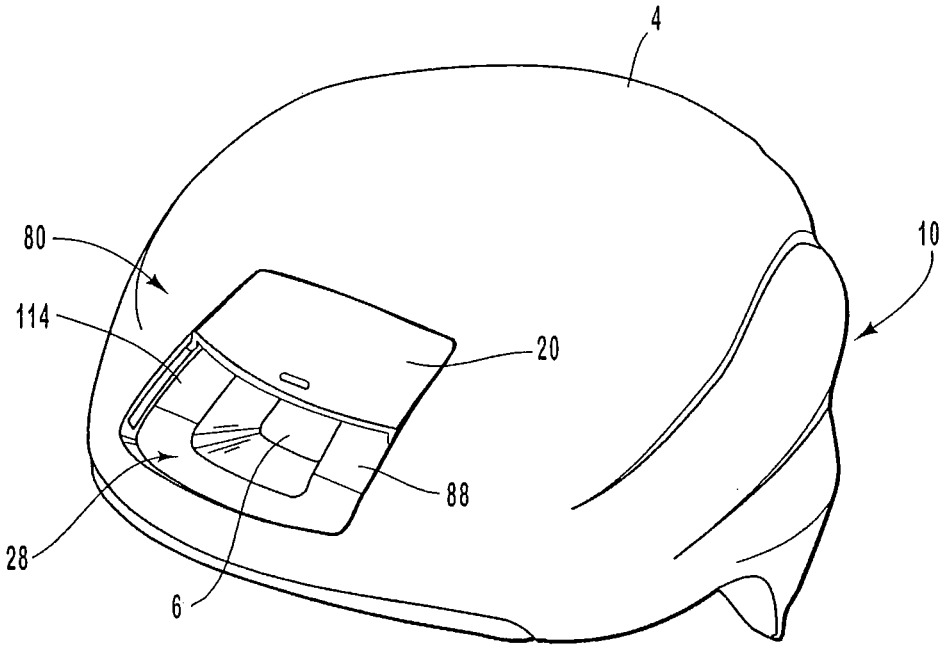
FIGS. 18-A and 18-B illustrate the embodiment of the protective helmet wherein simply a vent shield is slidably coupled to a recessed portion of the shell/liner composite.
Figure 18B:
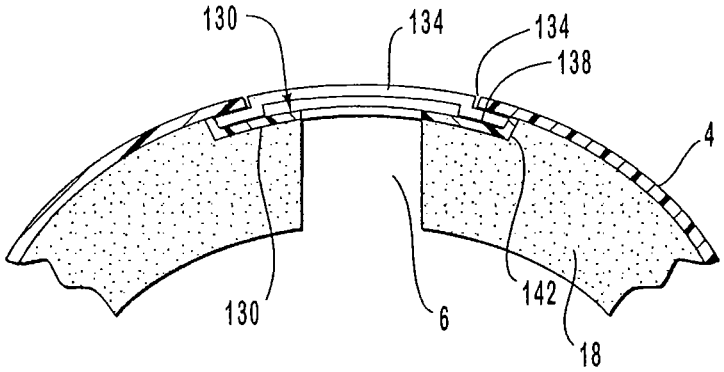
Figure 19A:
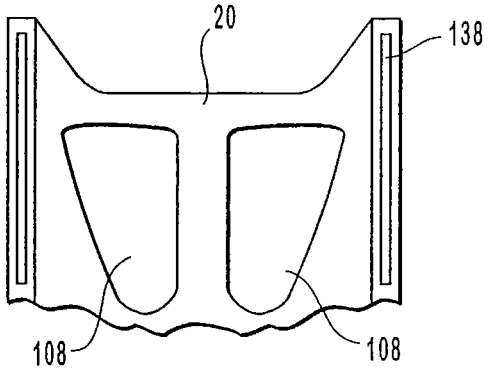
FIGS. 19-A and 19-B illustrate a detailed view of the glide and retaining rail mechanism used to couple the vent shield to the protective helmet for the embodiment described in FIGS. 18-A and 18-B.
Figure 19B:
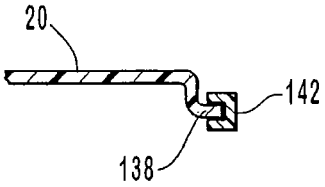
Figure 20:
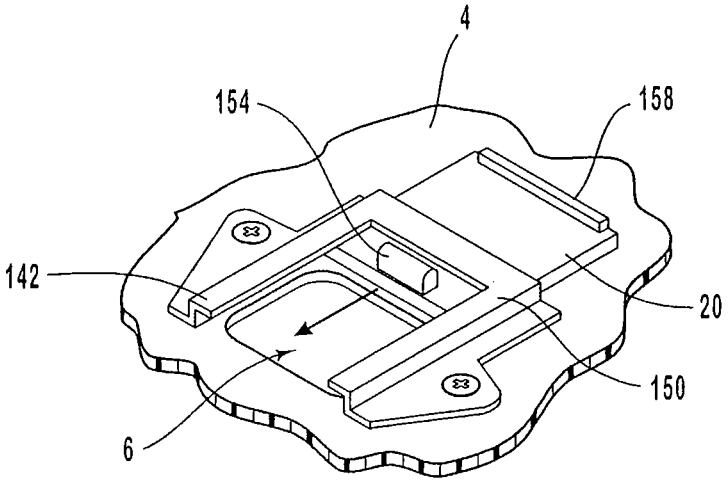
FIG. 20 illustrates yet another alternative ventilation system coupled to the exterior of the outer shell.

FIGS. 18-20 are illustrative of a sixth, alternative, embodiment of the protective helmet of the present invention. Specifically, FIG. 18-A shows ventilation system 80, which does not comprise an upper plate, as in the two previous embodiments, but merely a vent shield 20, slidably coupled to protective helmet 10. Vent shield 20 is not contained or housed within a vent box, but is independently coupled to helmet 10. Again, vent space 28 is created and exists as shown. Vent shield 20 may be coupled to a recessed portion 88 of helmet 10, or vent shield 20 may be coupled on a non-recessed portion of helmet 10. FIGS. 18-A and 18-B show vent shield 20 coupled within recessed portion 88, or vent space 28.

In FIGS. 18-A and 18-B, vent shield 20 is shown being capable of displacing bi-directionally over vent port 6 located in recessed portion 88. Vent shield 20 is contained within or coupled to recessed portion 88 using known means in the art, such that vent port 6 may be open, partially open, or closed to ambient air. Vent shield 20 may be coupled directly to protective helmet 10, or vent shield 20 may optionally be used in conjunction with an insert member 130 that allows vent shield 20 to slide or displace therein. Preferably, vent shield 20 is used in conjunction with recessed portion 88 to create a more aerodynamic profile to helmet 10.

FIG. 18-B shows a cut away sectional view of ventilation system 80 and vent shield 20 within insert member 130. Insert member 130 functions much the same as interchangeable insert members described above. Insert member 130 is shown having a grooved section or retaining rails 142. Vent shield 20 is shown having tongue portion 138. Tongue portion 138 is designed to fit within retaining rails 142, such that vent shield 20 may be displaced or slid in a bi-directional manner relative vent port 6. This relationship creates a dynamic vent system in which the wearer may regulate ventilation into helmet 10. One ordinarily skilled in the art will recognize that insert member 130 may utilize other means to couple vent shield 20 to helmet 10, besides a tongue and groove relationship, where vent shield 20 is allowed to move relative to vent port 6.

FIGS. 19-A and 19-B represent two detailed views of vent shield 20 and the tongue portions 138 that run along each side of vent shield 20. As described above, tongue portion 138 is capable of fitting within retaining rails or grooves 142 to create a dynamic relationship between helmet 10 and vent shield 20. Retaining rails 142 may be directly molded into helmet 10, in a recessed or non-recessed portion, or retaining rails 142 may optionally be incorporated into an insert member 130 designed to fit within recessed portion 88.

FIG. 20 illustrates how vent shield 20 may be attached using a separate retaining piece 150 used to contain vent shield 20 and attach directly to outer shell 4 over port 6. In this configuration, retainer 150 is attached to outer shell 4 using screws or another attachment means and comprises a groove 142 to house or retain the edges of vent shield 20 in a similar manner as described in FIGS. 19-A and 19-B above. In this setup, vent shield 20 may displace bi-directionally to open and close port 6 to control air flow in and out of helmet 10. Vent shield 20 may be limited in its travel by the contact of stopping means 154 and 158 with a portion of retainer 150 as shown.

Figure 21:
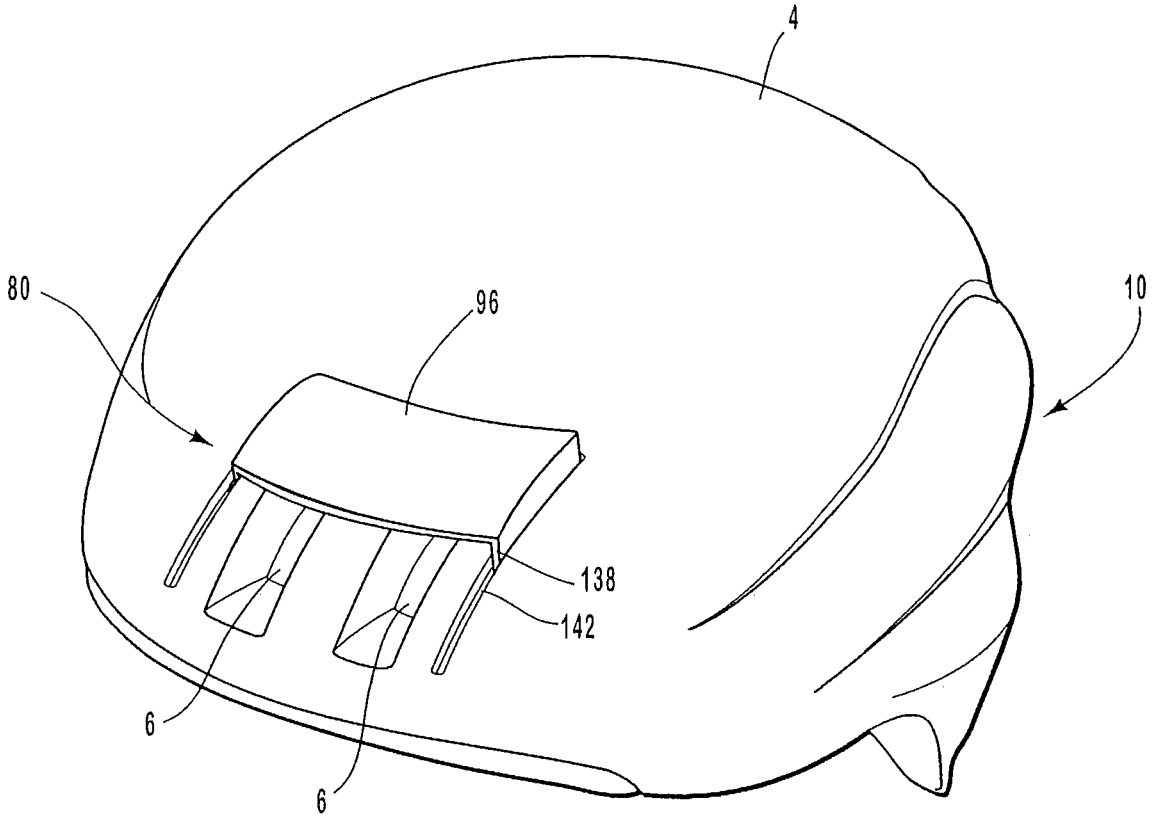
FIG. 21 illustrates a vent shield slidably coupled to the exterior of the protective helmet, without requiring a recessed portion therein.

FIG. 21, shows a version of the embodiment where vent shield 20 is coupled to helmet 10 independent of a vent box. In this version, vent shield 20 is slidably coupled to the exterior shell 4 of helmet 10, with helmet 10 having no recessed portion. Vent shield 20 is slidably coupled to shell 4 using a similar tongue and groove mechanism as described above. FIG. 21 also shows how retaining rails (or grooved portion) 142 may be molded directly into protective helmet 10 during the manufacturing process. Specifically, FIG. 20 shows shell 4 of helmet 10 having retaining rails 142 capable of receiving a tongue portion 138 of vent shield 20. This mechanism allows vent shield 20 to slide in a bi-directional manner relative to vent ports 6, two of which are shown in the drawing, into an open and closed position. This setup comprises ventilation system 80 designed to regulate ambient air flow. Again, any known means may be employed to attach vent shield 20 to protective helmet 10 as stated above. It will be obvious to one ordinarily skilled in the art that vent shield 20 may be coupled to protective helmet 10 using other means, such as rivets, screws, snaps, etc., and that the tongue and groove assembly described herein for any embodiment may be replaced with these other means.

Figure 22A:
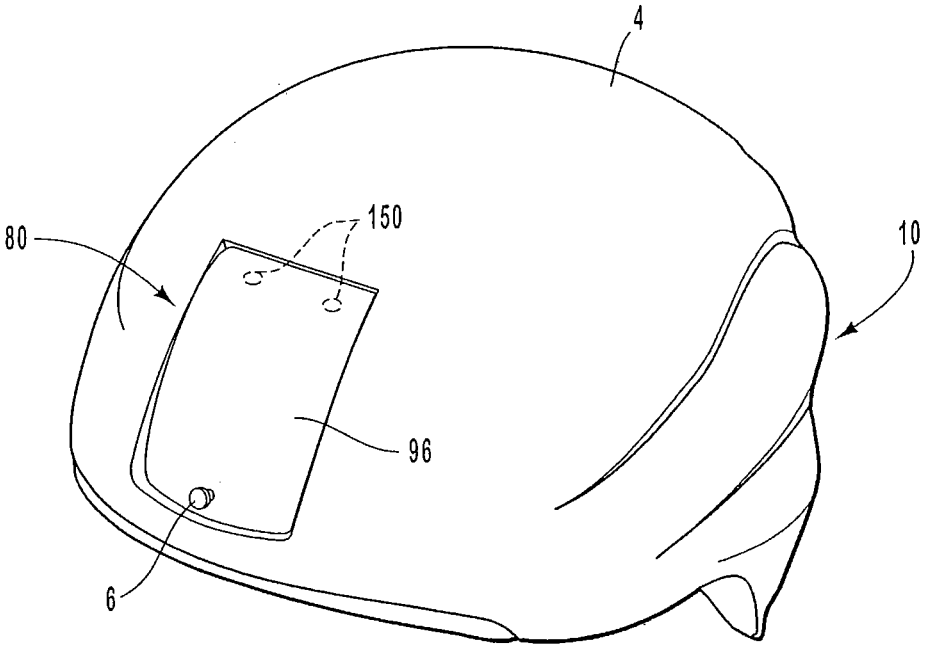
FIG. 22-A illustrates the embodiment of the protective helmet, wherein the ventilation system contained incorporated therein has at least one releasable attachment point.
Figure 22B:
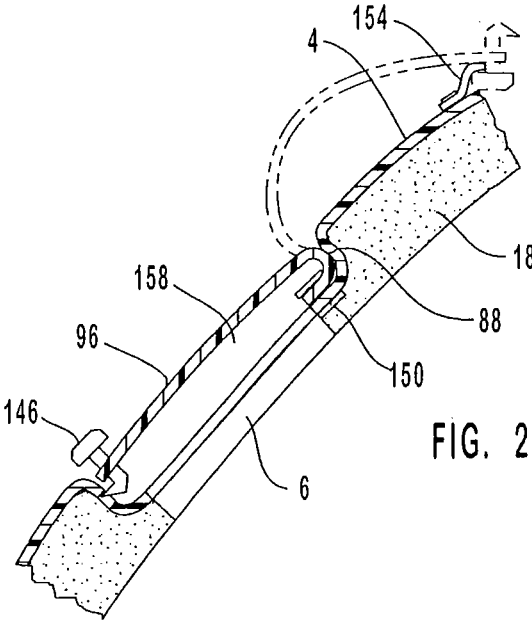

FIGS. 22-A and 22-B are illustrative of a seventh, alternative, embodiment of the present invention. Specifically, FIGS. 22-A and 22-B illustrate the shell/liner composite configuration of protective helmet 10 comprising a recessed portion 88 located therein, and a ventilation system 80 incorporated into helmet 10. Ventilation system 80 comprises a self-contained ventilation system 158, similar to the self-contained ventilation system described in the above third embodiment, or simply a vent shield 20. Ventilation system 80 may be inserted into recessed portion 88 to create an active ventilation system. However, ventilation system 80 comprises additional features or elements not found in the third embodiment discussed above.

In this embodiment, self-contained ventilation system 158 comprises at least one releasable attachment point 146, and at least one secure attachment point 150. This allows ventilation system 80 to swivel, rotate, and/or retract a substantial distance from recessed portion 88, thus leaving vent port 6 open to ambient air. When ventilation system 80 is detached from helmet 10 via its releasable attachment point, it may be secured to or positioned at another part of shell 4 of protective helmet 10 by reattaching that point 146 to a second attachment point 154. FIG. 22-B shows how ventilation system 158 may be rotated back and secured at second attachment point 154. When ventilation system 80 is repositioned to this point, vent port 6 is reduced to a passive vent. Alternatively, a stopper insert member may be placed in ventilation port to block airflow altogether when the ventilation system is relocated or moved to this second point. The advantage of this embodiment is that ventilation system 80 is not completely removed from helmet 10, but is rather relocated while still being coupled to helmet 10. As such, the wearer does not have to carry the released ventilation system, but can better keep track of its whereabouts as it is never removed from the protective helmet. The means used to release and attach ventilation system to helmet 10 at its various points may comprise any known means in the art. In FIG. 22, snaps are used.

In a variation of this embodiment, instead of self-contained ventilation system 80 being coupled to protective helmet 10, a stopper or plug may be coupled to helmet 10 in the same way. The stopper may be used to either completely block access of ambient airflow into the interior of helmet 10 when the stopper is positioned over the ventilation port, or to allow for passive airflow if the stopper is relocated as described above. In addition, obviously ventilation system 80 can be coupled to a protective helmet 10 having no recessed portion.

The protective helmet of the present invention may be composed of expanded polystyrene foam (EPS) as a helmet liner to meet the impact attenuation safety requirements. The popularity of EPS as a protective helmet or helmet liner is due to a combination of multiple factors, including its impact attenuation capability, low cost, ease of manufacturing and light weight. However, EPS has a number of drawbacks as a protective helmet liner as well. The mechanism of impact attenuation exhibited by EPS, while highly effective, causes permanent and irreversible damage to the EPS material. The EPS material does not recover significantly after a serious impact, so that repeated impacts at the same location on the helmet do not receive the same degree of impact attenuation.

Alternatively, to provide improved protection and greater or increased impact attenuation, the protective helmet of the present invention may comprise a laminated, dual density, closed-cell, foamed polymeric material, preferably a nitrogen blown, cross-linked, high-density polyethylene foam. An inner layer, or liner, of the helmet may be made of a closed-cell, foamed polymeric material with a relatively low density for comfort, for absorption of minor impacts and for distributing the stress of a major impact over a larger surface of the wearer's skull to lessen the likelihood of injury. The outer layer of the helmet may be made of a closed-cell, foamed polymeric material with a higher density for absorption of major impacts to the helmet and for providing a structurally stable shell to the helmet. Intermediate layers may be included between the inner and outer layers. Additional pads may be added to the inside surface of the helmet for customizing the fit and for spacing the helmet away from the wearer's head to increase ventilation.

The present invention may be embodied in other specific forms without departing from its spirit of essential characteristics. The described embodiments are to be considered in all respects only al illustrative and not restrictive. The scope of the invention is, therefore, indicated by the appended claims, rather than by the foregoing description. All changes which come within the meaning and range of equivalency of the claims are to be embraced within their scope.

The invention claimed is:

1. A protective helmet for selectively ventilating at least a top portion of a wearer's head and scalp when the helmet is worn, comprising:

an outer shell having a recessed portion and including a shelf formed within said recessed portion;

an inner liner comprised of impact absorbing material having impact attenuation properties to protect a wearer's head, said inner liner joined to said outer shell by an in-mold process to form a shell/liner composite, said shell/liner composite having a curved interior surface defining an interior volume of the protective helmet, said interior volume configured to receive at least a top portion of the wearer's head so that at least a portion of the wearer's scalp is adjacent to said curved interior surface of said shell/liner composite during use;

a ventilation port through said shell/liner composite and above a wearer's head when the helmet is worn, said ventilation port providing access for air to pass through said shell/liner composite and into or out of said interior volume of the protective helmet to ventilate said interior volume during use;

at least a portion of a ventilation system disposed within said recessed portion of said outer shell and interacting with said ventilation port to selectively control flow of air through said shell/liner composite and into or out of said interior volume of the protective helmet, said ventilation system comprising:

an upper member;

a lower member;

a vent space in said recessed portion between said upper member and said lower member; and a vent shield disposed within said vent space and capable of displacing within said vent space in relation to said ventilation port to selectively control flow of air through said shell/liner composite and into or out of said interior volume of the protective helmet to selectively ventilate at least a top portion of the wearer's head and scalp during use.

2. The protective helmet of claim 1, wherein said interior volume of the protective helmet is configured to receive a majority of a wearer's head and scalp.

3. The protective helmet of claim 1, wherein said inner liner includes an inner surface oriented toward said interior volume and adjacent a wearer's head and scalp during use.

4. The protective helmet of claim 1, wherein said outer shell has an outer surface oriented away from said interior volume and wherein said shelf is disposed elevationally below said outer surface of said outer shell.

5. The protective helmet of claim 1, wherein said inner liner has an outer surface oriented away from said interior volume and wherein said shelf is disposed elevationally below said outer surface of said inner liner.

6. The protective helmet of claim 1, wherein said ventilation system comprises a first vent hole through said upper member and a second vent hole through said lower member and wherein said first vent hole is positioned directly above said second vent hole.

7. The protective helmet of claim 1, wherein said vent space is contained between said upper member and said lower member and entirely within said recessed portion of said outer shell.

8. The protective helmet of claim 1, wherein said vent space is defined by a vent box utilizing said shelf of said outer shell as said lower member.

9. The protective helmet of claim 1, wherein said vent space is defined by a vent box utilizing said inner liner as said lower member.

10. The protective helmet of claim 1, wherein said vent space is defined by said shelf serving as said lower member and an attachable piece positioned within said recessed portion serving as said upper member.

11. The protective helmet of claim 1, wherein said vent space is defined by said shelf serving as said lower member and a second shell positioned over said outer shell serving as said upper member.

12. The protective helmet of claim 1, wherein said vent space is defined by an independent upper member coupled to an independent lower member to create an independent insert member attachable to said protective helmet over said ventilation port.

13. The protective helmet of claim 1, wherein the protective helmet comprises a plurality of ventilation ports formed through said shell/liner composite.

14. The protective helmet of claim 1, said ventilation system further comprising an actuator coupled to said vent shield for actuating displacement of said vent shield in said vent space.

15. A protective helmet for selectively ventilating at least a top portion of a wearer's head and scalp when the helmet is worn, comprising:

an outer shell having a recessed portion and including a shelf formed within said recessed portion;

an inner liner comprised of impact absorbing material having impact attenuation properties to protect a wearer's head, said inner liner joined to said outer shell by an in-mold process to form a shell/liner composite, said shell/liner composite having a curved interior surface defining an interior volume of the protective helmet, said interior volume configured to receive at least a top portion of the wearer's head so that at least a portion of the wearer's scalp is adjacent to said curved interior surface of said shell/liner composite during use;

ventilation ports extending through said shell/liner composite and above a wearer's head when the helmet is worn, the ventilation ports providing access for air to pass through said shell/liner composite and into or out of said interior volume of the protective helmet to ventilate said interior volume during use;

at least a portion of a ventilation system disposed within said recessed portion of said outer shell and interacting with said ventilation ports to selectively control flow of air through said shell/liner composite and into or out of said interior volume of the protective helmet, said ventilation system comprising:

an upper member;

a lower member;

a vent space in said recessed portion between said upper member and said lower member; and a vent shield disposed within said vent space and capable of displacing within said vent space in relation to said ventilation ports to selectively control flow of air through said shell/liner composite and into or out of said interior volume of the protective helmet to selectively ventilate at least a top portion of the wearer's head and scalp during use.

16. The protective helmet of claim 15, wherein said vent space is defined by said shelf serving as said lower member and an attachable piece positioned within said recessed portion serving as said upper member.

17. The protective helmet of claim 15, wherein said vent space is defined by said shelf serving as said lower member and a second shell positioned over said outer shell serving as said upper member.

* * * * *